US008582991B2

(12) United States Patent
Naitoh et al.

(10) Patent No.: US 8,582,991 B2
(45) Date of Patent: Nov. 12, 2013

(54) FIXING DEVICE AND IMAGE FORMING APPARATUS INCORPORATING SAME

(75) Inventors: Yutaka Naitoh, Hyogo (JP); Yoshiharu Takahashi, Osaka (JP); Shin Yamamoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 155 days.

(21) Appl. No.: 13/067,907

(22) Filed: Jul. 6, 2011

(65) Prior Publication Data

US 2012/0020681 A1 Jan. 26, 2012

(30) Foreign Application Priority Data

Jul. 26, 2010 (JP) ..... 2010-167286

(51) Int. Cl.
*G03G 15/20* (2006.01)

(52) U.S. Cl.
USPC ..... 399/45; 399/323

(58) Field of Classification Search
USPC ..... 399/323, 322, 398, 399, 388, 400, 45; 271/307, 308, 311, 900, 265.01
See application file for complete search history.

(56) References Cited

U.S. PATENT DOCUMENTS

| | | | | |
|---|---|---|---|---|
| 4,281,623 | A * | 8/1981 | Kato et al. | 118/668 |
| 7,769,332 | B2 | 8/2010 | Yamamoto et al. | |
| 7,831,186 | B2 | 11/2010 | Obata et al. | |
| 7,881,635 | B2 | 2/2011 | Yamazoe et al. | |
| 7,890,017 | B2 | 2/2011 | Naitoh et al. | |
| 7,945,203 | B2 | 5/2011 | Shimizu et al. | |
| 8,162,315 | B2 * | 4/2012 | Baba | 271/900 X |
| 8,320,807 | B2 * | 11/2012 | Onodera et al. | 399/323 |
| 2002/0164172 | A1 | 11/2002 | Tsubaki et al. | 399/45 |
| 2007/0140752 | A1 | 6/2007 | Yamamoto et al. | |
| 2007/0172278 | A1 | 7/2007 | Yamamoto | |
| 2008/0013993 | A1 | 1/2008 | Obata et al. | |
| 2008/0056783 | A1 | 3/2008 | Yamamoto et al. | |
| 2008/0193162 | A1 | 8/2008 | Yamazoe et al. | |
| 2009/0022531 | A1 | 1/2009 | Kubota et al. | |

(Continued)

FOREIGN PATENT DOCUMENTS

| | | |
|---|---|---|
| JP | 58-044474 | 3/1983 |
| JP | 58-044478 | 3/1983 |

(Continued)

OTHER PUBLICATIONS

European Search Report dated Nov. 23, 2011 for corresponding European Application No. 10168935.4.

(Continued)

*Primary Examiner* — Sophia S Chen
(74) *Attorney, Agent, or Firm* — Harness, Dickey & Pierce, P.L.C.

(57) ABSTRACT

A fixing device includes a separator presser that presses against a plurality of separators to separate the plurality of separators from a fixing rotary body that contacts an opposed rotary body to form a fixing nip therebetween through which a recording medium bearing a toner image passes. A single driver is connected to the separator presser to separate the separator presser from the plurality of separators. An entering recording medium detector is disposed upstream from the fixing nip in a conveyance direction of the recording medium to detect the recording medium. A controller is connected to the driver to control the driver based on a detection signal sent from the entering recording medium detector to change a contact time period for which the plurality of separators contacts the fixing rotary body.

18 Claims, 11 Drawing Sheets

(56) References Cited

U.S. PATENT DOCUMENTS

| | | | | |
|---|---|---|---|---|
| 2009/0060572 | A1 | 3/2009 | Naitoh et al. | |
| 2009/0074440 | A1 | 3/2009 | Nanno et al. | |
| 2009/0110418 | A1 | 4/2009 | Ogiso et al. | |
| 2009/0154973 | A1 | 6/2009 | Shimizu et al. | |
| 2009/0162101 | A1 | 6/2009 | Yoshida et al. | |
| 2009/0162772 | A1 | 6/2009 | Fuwa et al. | |
| 2009/0290893 | A1 | 11/2009 | Ogiso et al. | |
| 2009/0297233 | A1 | 12/2009 | Kameda | 399/322 |
| 2010/0034548 | A1 | 2/2010 | Naitoh et al. | |
| 2010/0054785 | A1 | 3/2010 | Ogiso et al. | |
| 2010/0232848 | A1 | 9/2010 | Naitoh | |
| 2011/0026944 | A1 | 2/2011 | Naitoh | |
| 2011/0188874 | A1 | 8/2011 | Takahashi et al. | 399/69 |

FOREIGN PATENT DOCUMENTS

| | | | | |
|---|---|---|---|---|
| JP | 59-184383 | | | 10/1984 |
| JP | 61-230179 | | | 10/1986 |
| JP | 4125583 | A | | 4/1992 |
| JP | 7140831 | A | | 6/1995 |
| JP | 9305053 | A | | 11/1997 |
| JP | 10-040871 | | | 2/1998 |
| JP | 2002-082562 | A | * | 3/2002 |
| JP | 2003186336 | A | | 7/2003 |
| JP | 2004067329 | A | | 3/2004 |
| JP | 2005024645 | A | | 1/2005 |
| JP | 2010026413 | A | | 2/2010 |
| JP | 2011-164334 | | | 8/2011 |

OTHER PUBLICATIONS

European Search Report dated Nov. 23, 2011 for corresponding European Application No. 11174029.6.

Office Action for corresponding Chinese patent application No. 201110208060.9 dated Sep. 4, 2013.

* cited by examiner

FIXING DEVICE AND IMAGE FORMING APPARATUS INCORPORATING SAME

PRIORITY STATEMENT

The present patent application claims priority from Japanese Patent Application No. 2010-167286, filed on Jul. 26, 2010 in the Japan Patent Office, which is hereby incorporated herein by reference in its entirety.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing rotary body heated by a heater, and an opposed rotary body that presses against the fixing rotary body to form a fixing nip therebetween. As a recording medium bearing a toner image passes through the fixing nip, the fixing rotary body and the opposed rotary body apply heat and pressure to the recording medium to melt and fix the toner image on the recording medium. Thereafter, the recording medium bearing the fixed toner image is discharged from the fixing nip.

However, it can happen that the recording medium bearing the toner image facing the fixing rotary body gets stuck to the surface of the fixing rotary body due to the adhesive force of the melted toner of the toner image. As a result, the recording medium may not be discharged from the fixing nip properly.

To address this problem, a separator such as a blade or a wedge may contact the surface of the fixing rotary body against the direction of rotation of the fixing rotary body to separate the recording medium from the fixing rotary body. However, because the separator remains in constant contact with the fixing rotary body, the surface of the fixing rotary body contacted by the separator experiences wear over time. As a result, the worn fixing rotary body may generate streaks and uneven glosses on the toner image.

To address this problem, the fixing device may further include a separator protection mechanism disposed downstream from the fixing nip in the conveyance direction of the recording medium to separate the separator from the fixing rotary body. When the recording medium lifts the separator protection mechanism, the separator, which is interlocked with the separator protection mechanism via a connecting member, is separated from the fixing rotary body. Accordingly, whenever the recording medium passes through the fixing nip and lifts the separator protection mechanism, the separator is separated from the fixing rotary body, shortening the time period for which the separator contacts the fixing rotary body and therefore minimizing wear of the surface of the fixing rotary body due to friction caused by the separator sliding over the fixing rotary body.

However, a separator configured to separate from the fixing rotary body only when the recording medium passes through the fixing nip as described above may not be effective in reducing wear of the surface of the fixing rotary body during warm-up of the fixing device, because more time is used to warm up the fixing device or to idle the fixing rotary body than to feed the recording medium through the fixing nip.

Alternatively, the fixing device may include a sensor that detects the recording medium conveyed toward the fixing nip and a solenoid that controls the separator based on a detection signal sent from the sensor. With this configuration, the separator contacts the fixing rotary body only when the recording medium passes through the fixing nip. Accordingly, the separator remains isolated from the fixing rotary body otherwise and thus for a longer time compared to a configuration in which the separator separates from the fixing rotary body only when the recording medium passes through the fixing nip, thus decreasing wear of the fixing rotary body.

However, each separator requires its own solenoid. Consequently, when a plurality of separators is provided in the fixing device, a plurality of solenoids is needed, upsizing the fixing device and increasing manufacturing costs. Moreover, when each of the plurality of solenoids is designed to respond at different times, the plurality of separators may not move simultaneously.

To address this problem, the plurality of separators may be combined with each other and a single solenoid may move the combined separators collectively. FIG. 1 is a schematic view of a known fixing device 20R including a plurality of separators 230 connected to each other by a connecting member 220, and contacting a fixing rotary body 210 to separate the recording medium from the fixing rotary body 210.

However, if there are variations in the dimensions of the individual separators 230 or the fixing rotary body 210 is bent or vibrates, a slight gap S may arise between one of the plurality of separators 230 (for example, the center separator 230) and the fixing rotary body 210. As a result, if all of the separators 230 do not contact the fixing rotary body 210 simultaneously, the recording medium may not be separated from the fixing rotary body 210 properly.

SUMMARY

At least one embodiment may provide a fixing device that includes a fixing rotary body, an opposed rotary body, a plurality of separators, a plurality of contact direction biasing members, a separator presser, a single driver, an entering recording medium detector, and a controller. The opposed rotary body contacts the fixing rotary body to form a fixing nip therebetween through which a recording medium bearing a toner image passes. The plurality of separators is disposed downstream from the fixing nip in a conveyance direction of the recording medium and is contactable to the fixing rotary body independently from each other. The plurality of separators contacts the fixing rotary body to separate the recording medium having passed through the fixing nip from the fixing rotary body. The plurality of contact direction biasing members is attached to the plurality of separators to exert a first bias to the plurality of separators to cause the plurality of separators to contact the fixing rotary body. The separator presser presses against the plurality of separators against the first bias exerted by the plurality of contact direction biasing members to separate the plurality of separators from the fixing rotary body. The single driver is connected to the separator presser to separate the separator presser from the plurality of separators. The entering recording medium detector is disposed upstream from the fixing nip in the conveyance direction of the recording medium to detect the recording medium. The controller is connected to the driver to control the driver based on a detection signal sent from the entering recording medium detector to change a contact time period for which the plurality of separators contacts the fixing rotary body.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
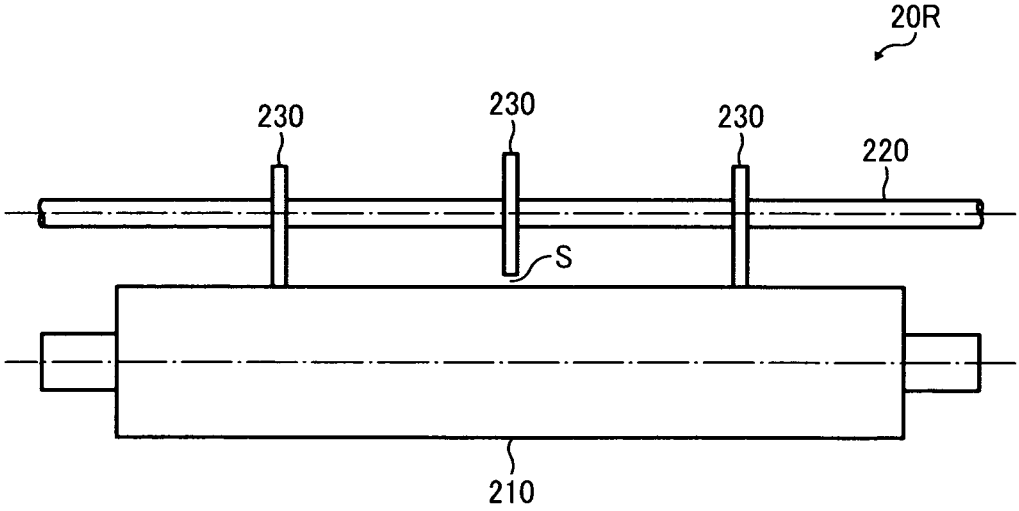
FIG. 1 RELATED ART
FIG. 1 is a schematic view of a related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
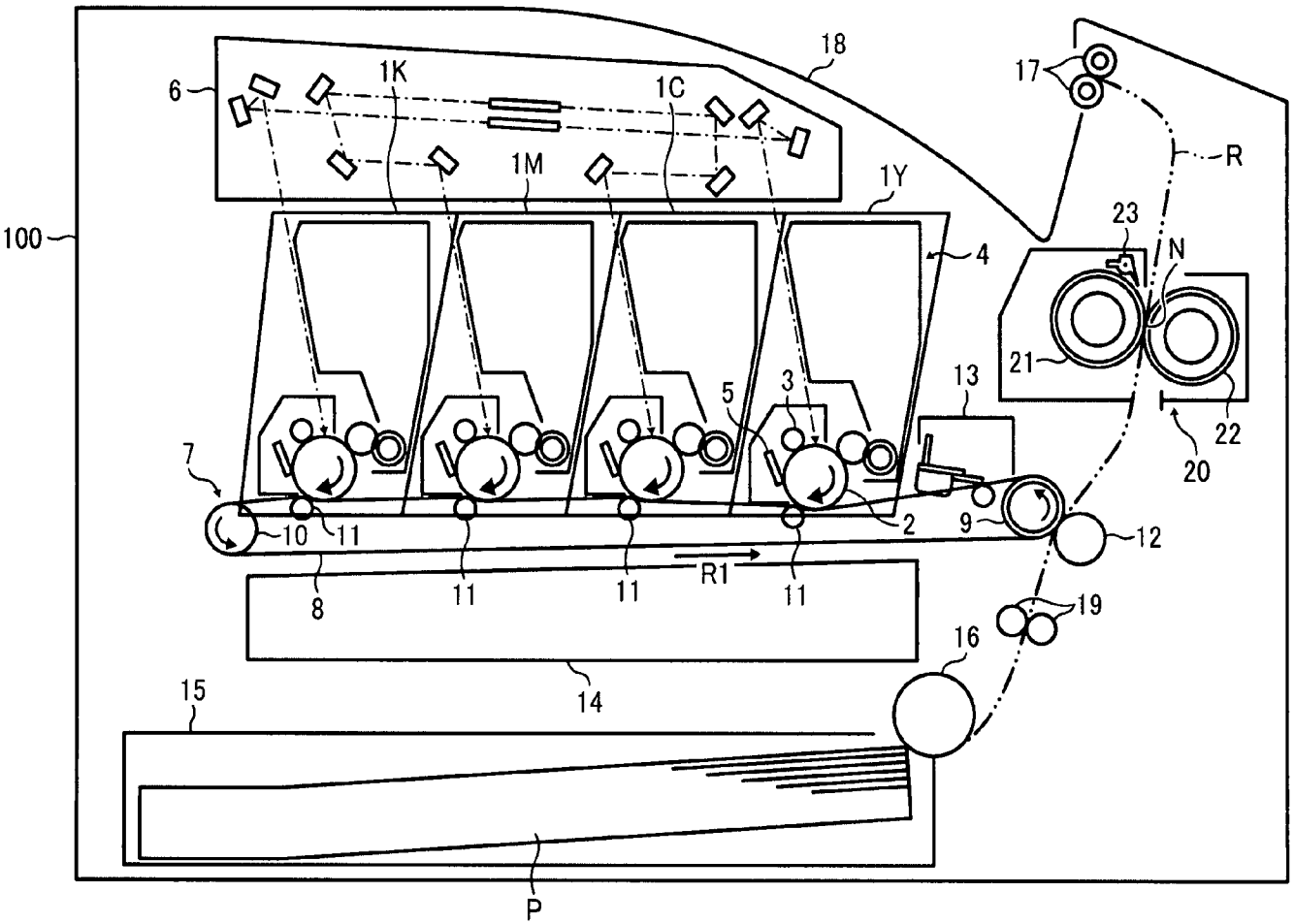
FIG. 2 is a schematic view of an image forming apparatus according to an example embodiment.

Referring now to the drawings, wherein like reference numerals designate identical or corresponding parts throughout the several views, particularly to FIG. 2, an image forming apparatus 100 according to an example embodiment is explained.

FIG. 2 is a schematic view of the image forming apparatus 100. As illustrated in FIG. 2, the image forming apparatus 100 may be a copier, a facsimile machine, a printer, a multifunction printer having at least one of copying, printing, scanning, plotter, and facsimile functions, or the like. According to this example embodiment, the image forming apparatus 100 is a copier for forming a color image on a recording medium by electrophotography.

Referring to FIG. 2, the following describes the structure of the image forming apparatus 100.

As illustrated in FIG. 2, the image forming apparatus 100 includes four process units 1Y, 1C, 1M, and 1K, disposed in a center portion of the image forming apparatus 100, detachably attached to the image forming apparatus 100. The process units 1Y, 1C, 1M, and 1K contain and use toners in different colors (e.g., yellow, cyan, magenta, and black corresponding to color separation components of a color image), respectively, but have a similar structure. Accordingly, the following describes the structure of the process unit 1Y which is equivalent to that of the process units 1C, 1M, and 1K.

For example, the process unit 1Y includes a photoconductive drum 2 (e.g., a photoconductor) serving as an image carrier that carries an electrostatic latent image and a resultant toner image; a charging roller 3 serving as a charger that charges a surface of the photoconductive drum 2; a development device 4 serving as a development device that supplies developer (e.g., toner) to the surface of the photoconductive drum 2; and a cleaning blade 5 serving as a cleaner that cleans the surface of the photoconductive drum 2.

It is to be noted that in FIG. 2 the reference numerals are assigned to the photoconductive drum 2, the charging roller 3, the development device 4, and the cleaning blade 5 of the process unit 1Y only.

Above the process units 1Y, 1C, 1M, and 1K is an exposure device 6 serving as an electrostatic latent image forming device that exposes the charged surface of the respective photoconductive drums 2 to form an electrostatic latent image thereon. Below the process units 1Y, 1C, 1M, and 1K is a transfer device 7 that includes an intermediate transfer belt 8, that is, an endless belt serving as a transfer member, which is stretched over a driving roller 9 and a driven roller 10 and moves or rotates in a rotation direction R1.

The transfer device 7 further includes four first transfer rollers 11 serving as first transfer members disposed opposite the four photoconductive drums 2 of the process units 1Y, 1C, 1M, and 1K, respectively. The first transfer rollers 11 contact an inner circumferential surface of the intermediate transfer belt 8 and press against the photoconductive drums 2 via the intermediate transfer belt 8, thus forming first transfer nips between the photoconductive drums 2 and the intermediate transfer belt 8 at positions where the photoconductive drums 2 contact the intermediate transfer belt 8, respectively. The driving roller 9 of the transfer device 7 is disposed opposite a second transfer roller 12 serving as a second transfer member that contacts an outer circumferential surface of the intermediate transfer belt 8 and presses against the driving roller 9 via the intermediate transfer belt 8, thus forming a second transfer nip between the second transfer roller 12 and the intermediate transfer belt 8 at a position where the second transfer roller 12 contacts the intermediate transfer belt 8.

The intermediate transfer belt 8 is disposed opposite a belt cleaner 13 at the right end thereof in FIG. 2, which removes residual toner from the outer circumferential surface of the intermediate transfer belt 8. The toner removed by the belt cleaner 13 is conveyed to a waste toner container 14 disposed below the transfer device 7 through a waste toner conveyance tube extending from an outlet of the belt cleaner 13 to an inlet of the waste toner container 14.

Below the waste toner container 14 in a lower portion of the image forming apparatus 100 are a paper tray 15 that loads a plurality of recording sheets P serving as recording media and a feed roller 16 that picks up and feeds a recording sheet P from the paper tray 15. Conversely, above the exposure device 6 in an upper portion of the image forming apparatus 100 are an output roller pair 17 and an output tray 18. The output roller pair 17 discharges the recording sheet P onto an outside of the image forming apparatus 100, that is, onto the output tray 18 that stocks the discharged recording sheets P.

Between the paper tray 15 and the output tray 18 is a conveyance path R through which the recording sheet P is conveyed from the paper tray 15 to the output tray 18. Between the feed roller 16 and the second transfer roller 12 in the conveyance path R is a registration roller pair 19. Between the second transfer roller 12 and the output roller pair 17 is a fixing device 20 (e.g., a fuser unit) that fixes a toner image on the recording sheet P. The fixing device 20 includes a fixing roller 21 serving as a fixing rotary body or a fixing member heated by a heat source, a pressing roller 22 serving as a pressing member or an opposed rotary body disposed opposite the fixing roller 21, and a plurality of separators 23. The pressing roller 22 presses against the fixing roller 21 to form a fixing nip N therebetween. The separators 23 separate the recording sheet P from the fixing roller 21.

According to this example embodiment, the pressing roller 22 serving as an opposed rotary body is pressed against the fixing roller 21 serving as a fixing rotary body by a pressing mechanism, forming the fixing nip N between the fixing roller 21 and the pressing roller 22. However, the fixing rotary body and the opposed rotary body are not limited to the rollers. For example, at least one of the fixing rotary body and the opposed rotary body may be an endless belt pressed by a roller or a pad disposed inside a loop formed by the endless belt against the other one of the fixing rotary body and the opposed rotary body. Further, the opposed rotary body may not be pressed against the fixing rotary body. For example, the opposed rotary body may merely contact the fixing rotary body.

Referring to FIG. 2, the following describes the operation of the image forming apparatus 100 having the above-described structure.

When an image forming job starts as the image forming apparatus 100 receives a print request sent from a client computer or specified by a user using a control panel disposed atop the image forming apparatus 100, a driver drives and rotates the photoconductive drum 2 of the respective process units 1Y, 1C, 1M, and 1K clockwise in FIG. 2. In the respective process units 1Y, 1C, 1M, and 1K, the charging roller 3 uniformly charges the surface of the photoconductive drum 2 to have a given polarity. The exposure device 6 emits a laser beam onto the charged surface of the photoconductive drum 2 to form an electrostatic latent image thereon according to image data corresponding to a single color, that is, one of yellow, cyan, magenta, and black. It is to be noted that image data corresponding to yellow, cyan, magenta, and black are generated by separating full-color image data. The development device 4 supplies toner of the corresponding color, that is, one of yellow, cyan, magenta, and black toners, to the electrostatic latent image formed on the photoconductive drum 2 to make the electrostatic latent image visible as one of yellow, cyan, magenta, and black toner images. Thus, the yellow, cyan, magenta, and black toner images are formed on the photoconductive drums 2 of the process units 1Y, 1C, 1M, and 1K, respectively.

As the driving roller 9 is driven and rotated counterclockwise in FIG. 2, it drives and rotates the intermediate transfer belt 8 in the rotation direction R1. The respective first transfer rollers 11 are applied with a voltage controlled to have a constant voltage or current of a polarity opposite a polarity of the yellow, cyan, magenta, and black toners, generating a transfer electric field at the first transfer nips between the first transfer rollers 11 and the photoconductive drums 2, respectively. The transfer electric field generated at the first transfer nips transfers the yellow, cyan, magenta, and black toner images formed on the photoconductive drums 2 of the process units 1Y, 1C, 1M, and 1K, respectively, onto the outer circumferential surface of the intermediate transfer belt 8 in such a manner that the yellow, cyan, magenta, and black toner images are superimposed on a same position on the intermediate transfer belt 8 sequentially. Thus, a full-color toner image is formed on the outer circumferential surface of the intermediate transfer belt 8.

The cleaning blade 5 of the respective process units 1Y, 1C, 1M, and 1K removes residual toner remaining on the surface of the photoconductive drum 2 therefrom after the yellow, cyan, magenta, and black toner images are transferred from the respective photoconductive drums 2 onto the intermediate transfer belt 8. Thereafter, a discharger of the respective process units 1Y, 1C, 1M, and 1K discharges the surface of the photoconductive drum 2 to initialize a surface potential of the photoconductive drum 2, thus the photoconductive drum 2 is ready for a next image forming job.

On the other hand, when the image forming job starts, the feed roller 16 disposed in the lower portion of the image forming apparatus 100 rotates and feeds a recording sheet P contained in the paper tray 15 toward the registration roller pair 19 in the conveyance path R. The registration roller pair 19 further feeds the recording sheet P toward the second transfer nip formed between the second transfer roller 12 and the driving roller 9 disposed opposite the second transfer roller 12 via the intermediate transfer belt 8 at a proper time. For example, the second transfer roller 12 is applied with a transfer voltage having a polarity opposite the polarity of the toners forming the full-color toner image formed on the intermediate transfer belt 8, generating a transfer electric field at the second transfer nip between the second transfer roller 12 and the intermediate transfer belt 8. The transfer electric field generated at the second transfer nip transfers the full-color toner image formed on the intermediate transfer belt 8 onto the recording sheet P at a time. Then, the recording sheet P bearing the full-color toner image is sent to the fixing device 20. As the recording sheet P bearing the full-color toner image passes through the fixing nip N between the fixing roller 21 and the pressing roller 22, the fixing roller 21 and the pressing roller 22 apply heat and pressure to the recording sheet P to melt and fix the full-color toner image on the recording sheet P. The recording sheet P bearing the fixed full-color toner image is separated from the fixing roller 21 by the separators 23, and is sent to the output roller pair 17 so that the output roller pair 17 outputs the recording sheet P onto the output tray 18. After the full-color toner image is transferred from the intermediate transfer belt 8 onto the recording sheet P as described above, the belt cleaner 13 removes residual toner remaining on the intermediate transfer belt 8 therefrom. Thereafter, the removed toner is sent and collected into the waste toner container 14.

The above-described image forming operation forms the full-color toner image on the recording sheet P. Alternatively, the image forming apparatus 100 may form a monochrome toner image by using one of the four process units 1Y, 1C, 1M, and 1K, or may form a two-color toner image or a three-color toner image by using two or three of the four process units 1Y, 1C, 1M, and 1K.

Figure 3:
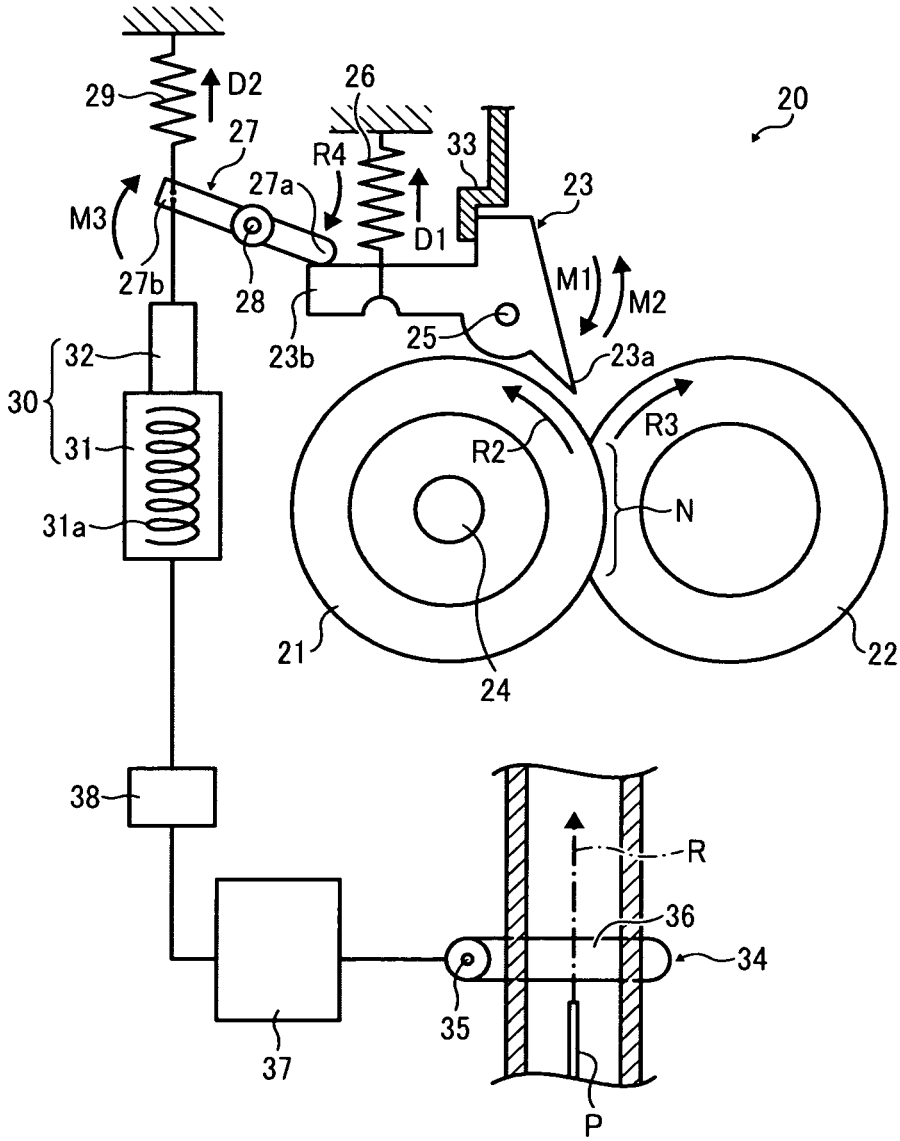
FIG. 3 is a vertical sectional view of a fixing device included in the image forming apparatus shown in FIG. 2 in a state in which separators are isolated from a fixing roller.
Figure 4:
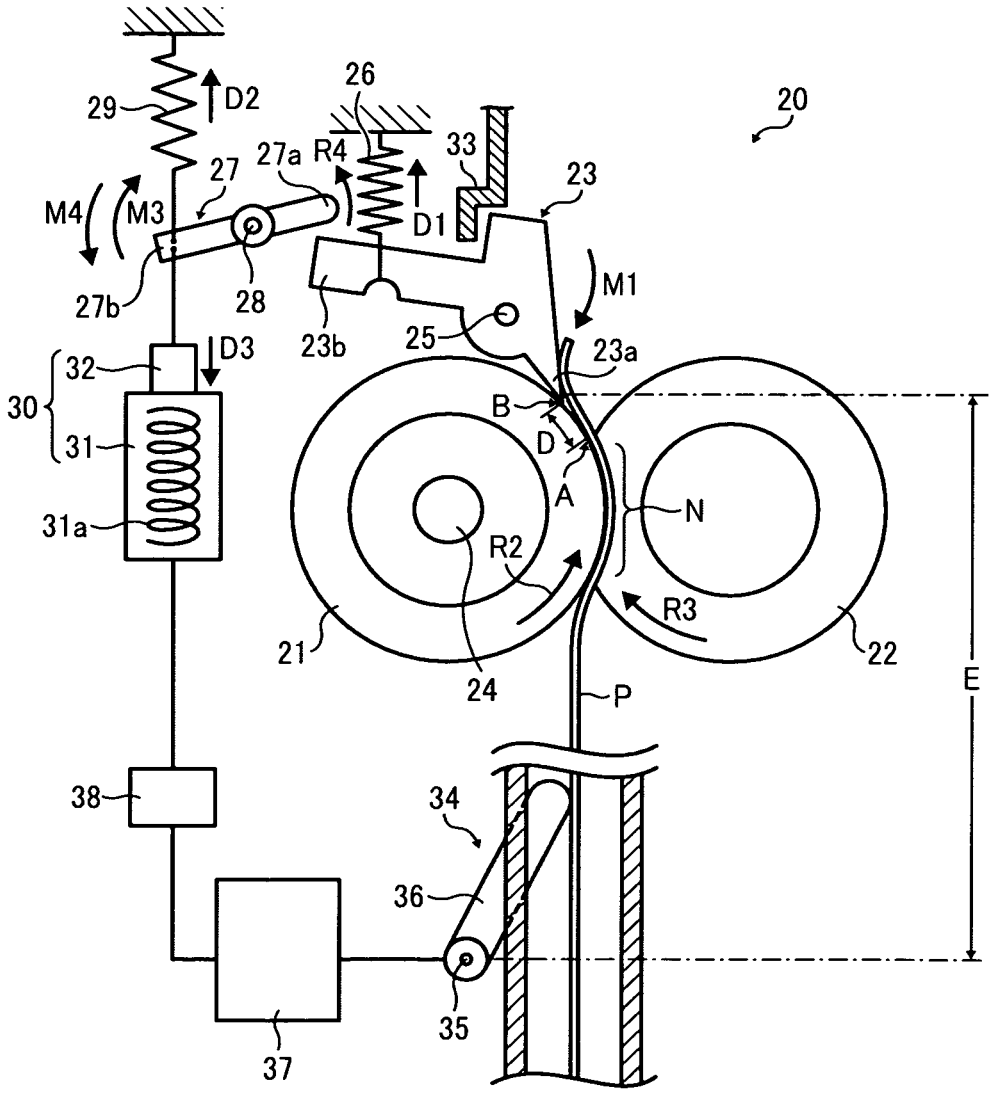
FIG. 4 is a vertical sectional view of the fixing device shown in FIG. 3 in a state in which the separators contact the fixing roller.
Figure 5:
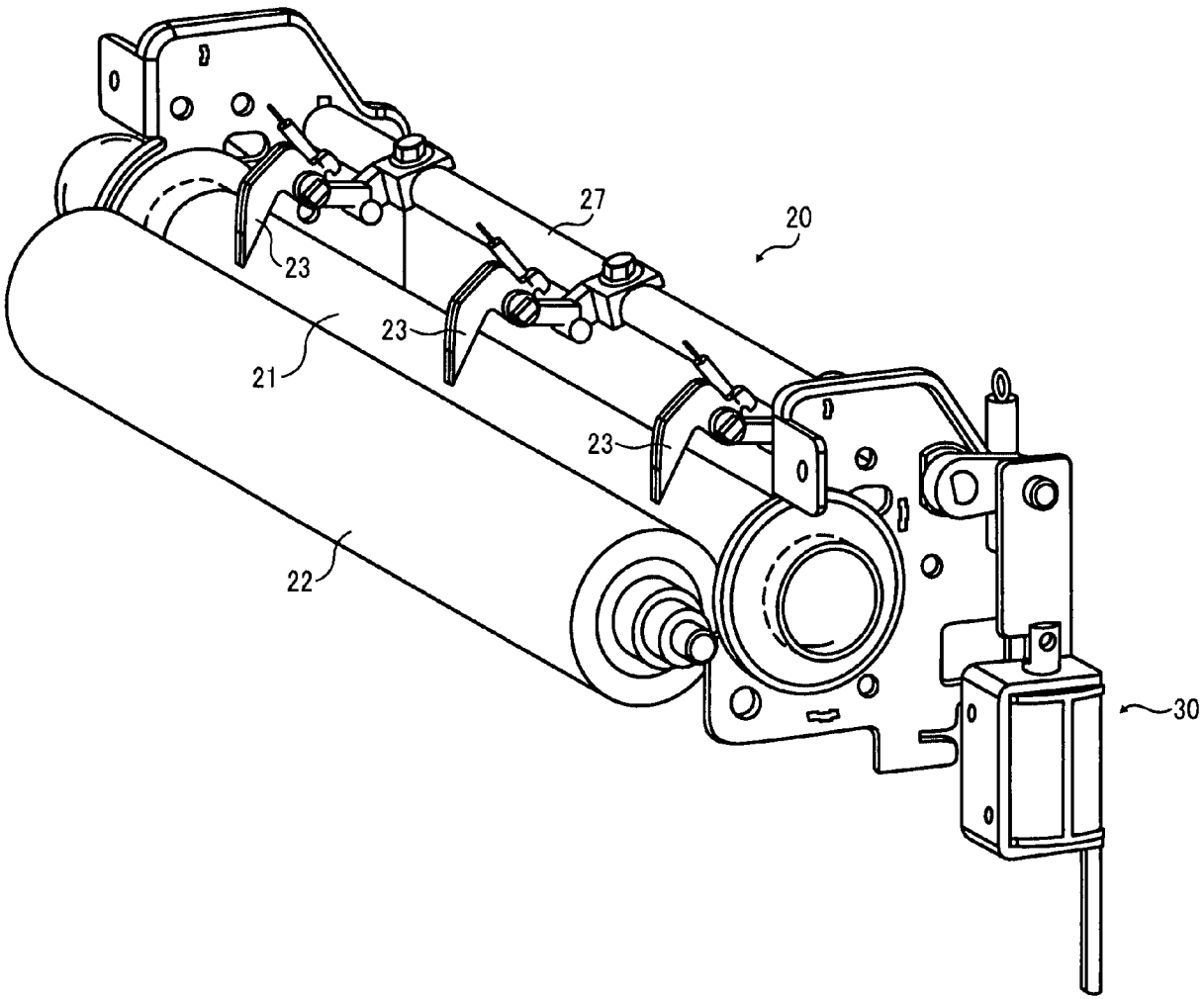
FIG. 5 is a perspective view of the fixing device shown in FIG. 3.

Referring to FIGS. 3 to 5, the following describes the structure of the fixing device 20 installed in the image forming apparatus 100 described above.

FIG. 3 is a vertical sectional view of the fixing device 20 in a state in which the separators 23 are isolated from the fixing roller 21. FIG. 4 is a vertical sectional view of the fixing device 20 in a state in which the separators 23 contact the fixing roller 21. FIG. 5 is a perspective view of the fixing device 20.

As illustrated in FIGS. 3 and 4, the fixing roller 21 and the pressing roller 22 contact each other to form the fixing nip N therebetween. Inside the fixing roller 21 is a heat source 24 that heats the fixing roller 21. The fixing roller 21 is rotatable counterclockwise in FIG. 3 in a rotation direction R2. Conversely, the pressing roller 22 is rotatable clockwise in FIG. 3 in a rotation direction R3 counter to the rotation direction R2 of the fixing roller 21.

For example, the cylindrical fixing roller 21 is constructed of three layers: a heat conductive base layer, an elastic layer disposed on the base layer, and a surface covering layer disposed on the elastic layer. The base layer, having a desired mechanical strength, is made of a material having proper thermal conductivity such as carbon steel and/or aluminum. The elastic layer is made of synthetic rubber such as silicone rubber and/or fluorocarbon rubber. The covering layer, which is disposed on an outer side or an outer circumferential surface of the elastic layer, is made of a material having high thermal conductivity and high heat resistance that facilitates releasing of toner from the fixing roller 21 and enhances durability of the elastic layer. For example, the covering layer may be a tube made of fluorocarbon resin such as tetrafluoroethylene-perfluoroalkylvinylether copolymer (PFA), a coating layer coated with fluorocarbon resin such as PFA or polytetrafluoroethylene (PTFE), a silicone rubber layer, or a fluorocarbon rubber layer.

The cylindrical pressing roller 22 is constructed of three layers: a metal core, an elastic layer disposed on an outer side or an outer circumferential surface of the metal core, and a surface covering layer disposed on the elastic layer. For example, the metal core is made of an STKM steel pipe classified under Carbon Steel Tubes for Machine Structural Purposes of Japanese Industrial Standards. The elastic layer is made of silicone rubber, fluorocarbon rubber, silicone rubber foam, and/or fluorocarbon rubber foam. The covering layer is a heat-resistant fluorocarbon resin tube made of PFA and/or PTFE that facilitates releasing of toner from the pressing roller 22.

The fixing device 20 may further include a thermistor serving as a temperature detector that detects a surface temperature of the fixing roller 21 and a thermostat disposed opposite the fixing roller 21 to prevent abnormal temperature increase of the fixing roller 21. The thermostat controls the surface temperature of the fixing roller 21 within a given temperature range based on a detection signal generated by the thermistor.

Downstream from the fixing nip N in a conveyance direction of the recording sheet P, that is, at an upper position in FIGS. 3 and 4, are the separators 23 disposed opposite the fixing roller 21. According to this example embodiment, the three separators 23 are arranged in an axial direction of the fixing roller 21 as shown in FIG. 5. However, the number of the separators 23 is not limited to three, thus may be any number not smaller than two. Each of the separators 23 is supported by an axis 25 in such a manner that each separator 23 is rotatable about the axis 25 independently from other separators 23. As each separator 23 rotates about the axis 25 clockwise or counterclockwise in FIG. 3, a front edge 23*a* of the separator 23 contacts and separates from the fixing roller 21 independently from other separators 23. FIG. 3 illustrates the separator 23 isolated from the fixing roller 21. By contrast, FIG. 4 illustrates the separator 23 contacting the fixing roller 21.

As shown in FIG. 4, a distance D between an exit A of the fixing nip N, that is, a downstream edge of the fixing nip N in the conveyance direction of the recording sheet P, and a contact position B on the fixing roller 21 where the front edge 23*a* of the separator 23 contacts the fixing roller 21 is set in a range of from about 5 mm to about 6 mm. The distance D is determined based on movement of the recording sheet P discharged from the exit A of the fixing nip N to cause the front edge 23*a* of the separator 23 to contact the fixing roller 21 at the contact position B, that is, a position where the recording sheet P is isolated farthest from an outer circumferential surface of the fixing roller 21, thus decreasing load applied to the recording sheet P as the separator 23 separates the recording sheet P from the fixing roller 21 and therefore minimizing damage to the recording sheet P.

The separator 23 is made of a material that facilitates releasing of the separator 23 from the fixing roller 21 and sliding of the separator 23 over the fixing roller 21, such as PFA, polyetherketone (PEK), and/or polyetheretherketone (PEEK). Alternatively, a surface of the separator 23 may be coated with a material that facilitates the releasing and sliding of the separator 23, such as PFA and/or Teflon®.

The separator 23 is attached with a contact direction biasing member 26 at a base 23*b* of the separator 23 disposed opposite the front edge 23*a*. According to this example embodiment, an extension coil spring is used as the contact direction biasing member 26. Alternatively, a compression coil spring, a torsion coil spring, or other biasing member may be used as the contact direction biasing member 26 according to various conditions, such as installation space and manufacturing costs. The contact direction biasing member 26 biases the separator 23 in a direction D1 to move the front edge 23*a* of the separator 23 toward the fixing roller 21 to contact the fixing roller 21.

In proximity to the base 23*b* of the separator 23 is a separator presser 27 (e.g., a lever) configured to press against the base 23*b* of the separator 23 to release contact of the separator 23 to the fixing roller 21 as shown in FIG. 3. The separator presser 27 is rotatably supported by an axis 28. As the separator presser 27 rotates about the axis 28 clockwise or counterclockwise in FIG. 3, a front edge 27*a* of the separator presser 27 disposed opposite the base 23*b* of the separator 23 contacts and separates from the base 23*b* of the separator 23. The separator presser 27 extends in a direction parallel to the axial direction of the fixing roller 21 to contact all of the plurality of separators 23, that is, the three separators 23 shown in FIG. 5.

The separator presser 27 is made of a heat-resistant, durable resin material such as polyphenylene sulphide (PPS) and/or PEK, which is lightweight and has a desired mechanical strength. According to this example embodiment, the axis 28, that is, a rotary shaft of the separator presser 27, is separately provided from the separator presser 27 and made of SUS stainless steel so as to prevent bending of the separator presser 27 in an axial direction, that is, in a longitudinal direction of the separator presser 27. The material of the separator presser 27 may be determined according to the size of the fixing device 20 and a bias exerted to the separator 23 by the contact direction biasing member 26.

Disposed opposite the front edge 27*a* of the separator presser 27 is a base 27*b* attached with a non-contact direction biasing member 29 that biases the separator presser 27 in a direction D2 in which the non-contact direction biasing member 29 pulls the separator presser 27 to cause the separator presser 27 to press against the base 23*b* of the separator 23, thus separating the separator 23 from the fixing roller 21 as shown in FIG. 3. According to this example embodiment, an extension coil spring is used as the non-contact direction biasing member 29. Alternatively, a compression coil spring, a torsion coil spring, or other biasing member may be used as the non-contact direction biasing member 29 according to various conditions, such as installation space and manufacturing costs. As the extension coil spring of the non-contact direction biasing member 29 attached to the base 27*b* of the separator presser 27 pulls the base 27*b* of the separator presser 27, the front edge 27*a* of the separator presser 27 contacts the base 23*b* of the separator 23.

The separator presser 27 is connected to a solenoid 30 serving as a driver that drives the separator presser 27. The solenoid 30 includes a body 31 inside which a coil 31*a* is disposed, and a plunger 32 that moves into and out of the coil 31*a*. The plunger 32 is connected to the base 27*b* of the separator presser 27 attached with the non-contact direction biasing member 29. As the coil 31*a* disposed inside the body 31 is excited, and the plunger 32 is pulled and retracted into the body 31, the separator presser 27 is driven and rotated.

Above the separator 23 is a detent 33 serving as a stopper that stops the separator 23 at a given position where the separator 23 is isolated from the fixing roller 21. The detent 33 also serves as a part of an exit guide disposed downstream from the fixing nip N in the conveyance direction of the recording sheet P to guide the recording sheet P discharged from the fixing nip N. When the separator 23 contacts the detent 33, the detent 33 stops the separator 23 at a given distance from the fixing roller 21. Thus, the detent 33 maintains a desired distance between the separator 23 and the outer circumferential surface of the fixing roller 21 regardless of variation in size or assembly of the components of the plurality of separators 23.

Below and upstream from the fixing nip N in the conveyance direction of the recording sheet P is an entering recording medium detector 34 that detects the recording sheet P. The entering recording medium detector 34 includes a feeler 36 supported by an axis 35 in such a manner that the feeler 36 is swingable or rotatable about the axis 35. As shown in FIG. 3, before the recording sheet P contacts the entering recording medium detector 34, the feeler 36 is at a standby position where the feeler 36 intersects with the conveyance path R that conveys the recording sheet P. By contrast, when the recording sheet P contacts the feeler 36, the feeler 36 swings or rotates as shown in FIG. 4 and detects the recording sheet P. After the recording sheet P passes through the feeler 36, weight of the feeler 36 or a biasing member (e.g., a torsion coil spring) returns the feeler 36 to the standby position shown in FIG. 3. For example, the feeler 36 contacts a detent, and the detent stops the feeler 36 at the standby position shown in FIG. 3.

Preferably, the feeler 36 may be disposed in proximity to a center of the conveyance path R in a width direction of the conveyance path R perpendicular to the conveyance direction of the recording sheet P so that the recording sheet P is not skewed by the feeler 36 contacting it. Thus, the feeler 36 conveys the recording sheet P properly with improved conveyance reliability to prevent distortion of the toner image on the recording sheet P and creasing of the recording sheet P.

Figure 6:
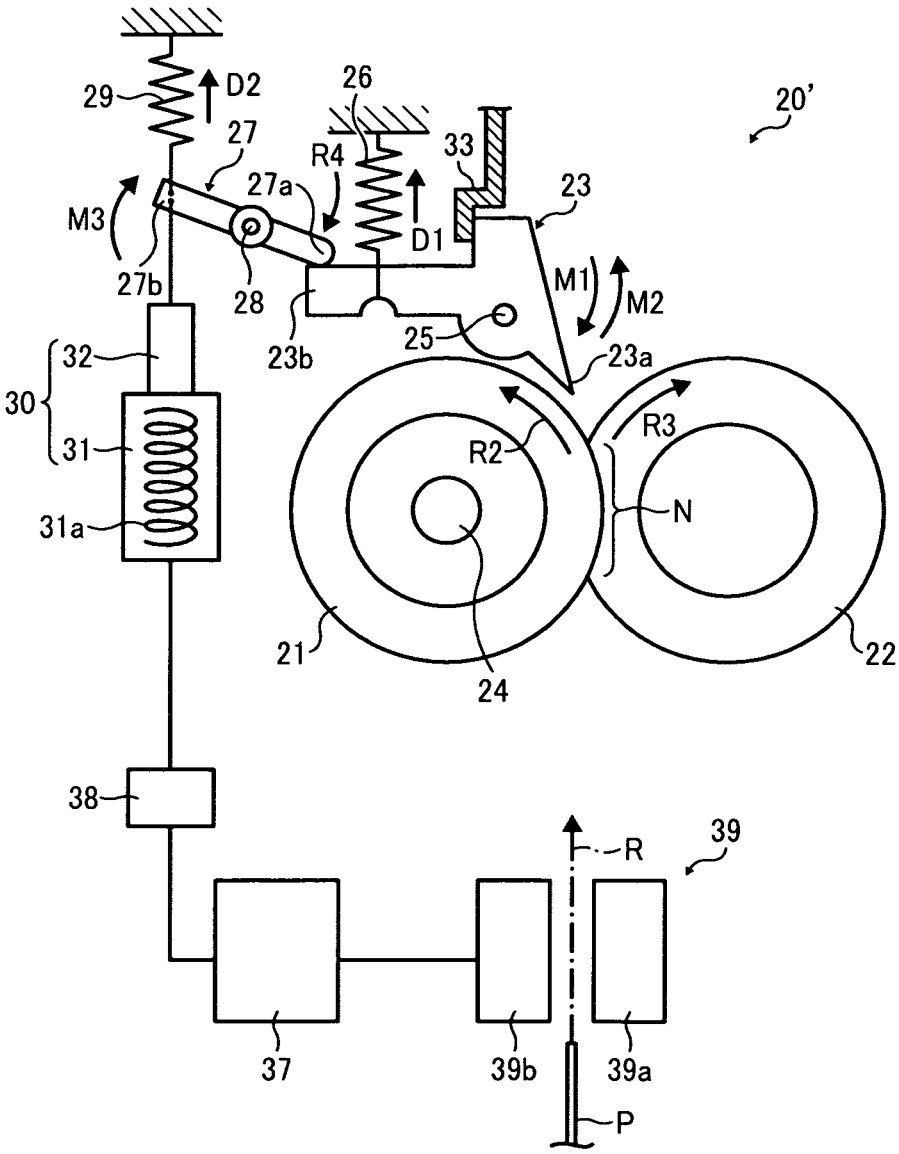
FIG. 6 is a vertical sectional view of a fixing device according to another example embodiment.

According to this example embodiment, the fixing device 20 employs the entering recording medium detector 34 serving as a contact type detector that detects the recording sheet P by contacting it. Alternatively, the fixing device 20 may employ a non-contact type detector that detects the recording sheet P without contacting it. FIG. 6 is a vertical sectional view of a fixing device 20' including such non-contact type detector, that is, an optical sensor 39.

The optical sensor 39 is a transmission type optical sensor, disposed upstream from the fixing nip N in the conveyance direction of the recording sheet P, which detects the recording sheet P conveyed toward the fixing nip N without contacting it.

The optical sensor 39 includes a light emitter 39*a* and a light receiver 39*b* sandwiching the conveyance path R in which the recording sheet P is conveyed toward the fixing nip N. The light emitter 39*a* emits light toward the light receiver 39*b*. When the recording sheet P passing between the light emitter 39*a* and the light receiver 39*b* blocks the light emitted by the light emitter 39*a* toward the light receiver 39*b*, the optical sensor 39 detects the recording sheet P. By contrast, when the light receiver 39*b* receives the light emitted by the light emitter 39*a* toward the light receiver 39*b*, the optical sensor 39 does not detect the recording sheet P.

Alternatively, a reflection type optical sensor may be used as a non-contact type detector. The non-contact type detector, either the transmission type optical sensor (e.g., the optical sensor 39) or the reflection type optical sensor, may not skew the conveyed recording sheet P.

The entering recording medium detector 34 depicted in FIG. 3 or the optical sensor 39 depicted in FIG. 6 may also serve as a jam detector that detects a jammed recording sheet P. In other words, with a configuration in which a jam detector is disposed upstream from the fixing nip N in the conveyance direction of the recording sheet P to detect the jammed recording sheet P, the jam detector may also serve as the entering recording medium detector 34 or the optical sensor 39 that detects the recording sheet P conveyed toward the fixing nip N. Accordingly, a separate detector for detecting the recording sheet P is not needed, resulting in the downsized fixing device 20 or 20' and reduced manufacturing costs of the fixing device 20 or 20'.

As shown in FIG. 4, the solenoid 30 is driven based on a detection signal provided by the entering recording medium detector 34 or the optical sensor 39 depicted in FIG. 6. For example, the solenoid 30 is electrically connected to the entering recording medium detector 34 or the optical sensor 39 via a driving circuit 38 and a controller 37. The controller 37 is a central processing unit (CPU) inside which an input/output (I/O) port is provided. When the entering recording medium detector 34 or the optical sensor 39 detects the conveyed recording sheet P, the controller 37 drives the solenoid 30 via the driving circuit 38 based on a detection signal sent from the entering recording medium detector 34 or the optical sensor 39.

Referring to FIGS. 3 and 4, the following describes the operation of the fixing device 20 having the above-described structure.

Before the recording sheet P contacts the entering recording medium detector 34 as shown in FIG. 3, the entering recording medium detector 34 does not detect the recording sheet P. Accordingly, the solenoid 30 does not generate a driving force, and therefore the separator presser 27 does not receive the driving force from the solenoid 30. Instead, the separator presser 27 receives a bias from the non-contact direction biasing member 29. For example, when the non-contact direction biasing member 29 pulls the base 27*b* of the separator presser 27 upward in the direction D2 in FIG. 3, a force in a clockwise direction, that is, a rotation moment M3, is exerted to the separator presser 27. The rotation moment M3 causes the front edge 27*a* of the separator presser 27 to press against the base 23*b* of each of the separators 23 downward.

When the separator presser 27 presses against the base 23*b* of each separator 23 downward, a force in a counterclockwise direction, that is, a rotation moment M2, is exerted to each separator 23. By contrast, when the contact direction biasing member 26 pulls the base 23*b* of the separator 23 upward in the direction D1, a force in a clockwise direction, that is, a rotation moment M1, is exerted to the separator 23. Thus, each separator 23 is exerted with the rotation moment M1 and the rotation moment M2 opposite the rotation moment M1. However, the force in the counterclockwise direction, that is, the rotation moment M2, is greater than the force in the clockwise direction, that is, the rotation moment M1. Accordingly, the front edge 23*a* of each separator 23 is isolated from the fixing roller 21.

For example, when the recording sheet P is not supplied to the fixing nip N, the rotation moment M2, that is, the force exerted by the non-contact direction biasing member 29 to the separators 23 via the separator presser 27 in a direction to separate the separators 23 from the fixing roller 21, is greater than the rotation moment M1, that is, the force exerted by the contact direction biasing members 26 to the separators 23 in a direction to cause the separators 23 to contact the fixing roller 21. Accordingly, the separators 23 are isolated from the fixing roller 21 to minimize wear of the fixing roller 21 due to contact of the separators 23 to the fixing roller 21. Consequently, proper fixing of the toner image on the recording sheet P can be maintained for an extended period of time. The detent 33, which contacts the separator 23 isolated from the fixing roller 21, maintains a given distance between the separator 23 and the fixing roller 21.

When the recording sheet P contacts the feeler 36 of the entering recording medium detector 34 and therefore the entering recording medium detector 34 detects the recording sheet P as shown in FIG. 4, the controller 37 drives the solenoid 30 via the driving circuit 38 based on a detection signal sent from the entering recording medium detector 34. For example, when a given electric current is applied to the solenoid 30, the plunger 32 is pulled and retracted into the body 31. Accordingly, the base 27*b* of the separator presser 27 is pulled downward in a direction D3, and a force in a counterclockwise direction, that is, a rotation moment M4, is exerted to the separator presser 27. On the other hand, the non-contact direction biasing member 29 exerts the rotation moment M3, that is, the force in the clockwise direction to the separator presser 27. However, the rotation moment M4, that is, the force in the counterclockwise direction exerted by the solenoid 30, is greater than the rotation moment M3. Accordingly, the separator presser 27 rotates counterclockwise in a rotation direction R4. Consequently, the front edge 27*a* of the separator presser 27 separates from the base 23*b* of each separator 23, thus releasing pressure applied by the separator presser 27 to the separators 23.

When pressure applied by the separator presser 27 to each separator 23 is released, the separator 23 is exerted with the rotation moment M1 only, that is, the force in the clockwise direction exerted by the contact direction biasing member 26. Accordingly, the separators 23 rotate clockwise in FIG. 4, and thus the front edge 23*a* of each separator 23 contacts the fixing roller 21. Consequently, the separators 23 separate the recording sheet P discharged from the fixing nip N from the fixing roller 21.

Thereafter, when a trailing edge of the recording sheet P passes through the fixing nip N, the controller 37 breaks the electric current applied to the solenoid 30, thus releasing retraction of the plunger 32 pulled into the body 31. Accordingly, the force exerted by the non-contact direction biasing member 29 to the separator presser 27, that is, the rotation moment M3, causes the separator presser 27 to press against the separators 23. The separator presser 27 pressing against the separators 23 exerts the rotation moment M2, that is, the force in the counterclockwise direction in FIG. 3, to the separators 23 again. As described above, the rotation moment M2 exerted to the separator 23 in the counterclockwise direction is greater than the rotation moment M1 exerted by the contact direction biasing member 26 to the separator 23 in the clockwise direction. Accordingly, each separator 23 rotates counterclockwise in FIG. 3 so that the front edge 23*a* of each separator 23 separates from the fixing roller 21. Thus, whenever the recording sheet P is conveyed to the fixing nip N, the separators 23 contact and separate from the fixing roller 21 as described above.

Figure 7:
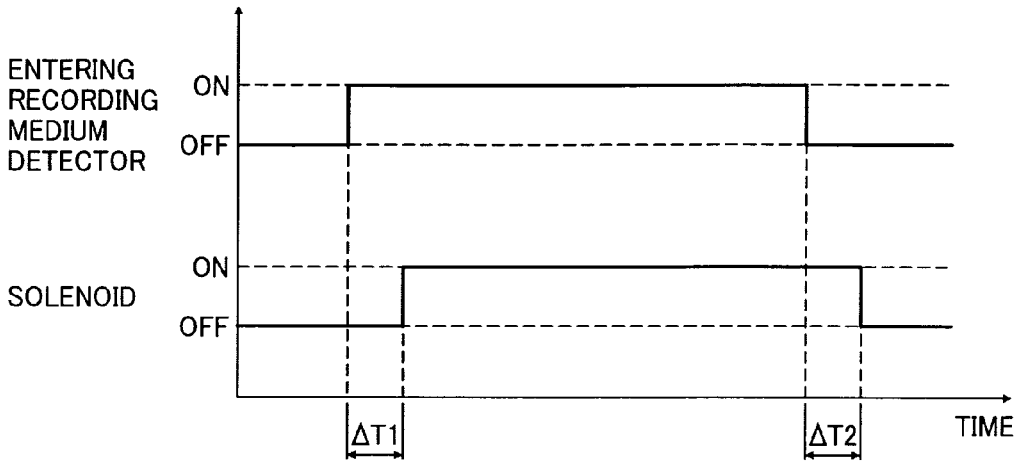
FIG. 7 is a timing chart showing one example of the operation of an entering recording medium detector and a solenoid included in the fixing device shown in FIG. 3.

FIG. 7 is a timing chart showing one example of the operation of the entering recording medium detector 34 and the solenoid 30 described above.

As illustrated in FIG. 7, the solenoid 30 is turned on when a given time period ΔT1 elapses after the entering recording medium detector 34 detects the recording sheet P, that is, after the entering recording medium detector 34 is turned on. For example, the recording sheet P contacts the separators 23 when a given time period elapses after the entering recording medium detector 34 detects the recording sheet P. Accordingly, the controller 37 does not drive the solenoid 30 immediately after the entering recording medium detector 34 detects the recording sheet P to cause the separators 23 to contact the fixing roller 21, but drives the solenoid 30 to cause the separators 23 to contact the fixing roller 21 immediately before the recording sheet P contacts the separators 23, so as to reduce wear of the fixing roller 21.

The solenoid 30 is turned off when a given time period ΔT2 elapses after the entering recording medium detector 34 no longer detects the recording sheet P, that is, after the entering recording medium detector 34 is turned off. It is because, if the controller 37 stops driving the solenoid 30 immediately after the entering recording medium detector 34 no longer detects the recording sheet P, the separators 23 may separate from the fixing roller 21 before the trailing edge of the recording sheet P passes through the separators 23, degrading separation of the recording sheet P from the fixing roller 21 and conveyance of the recording sheet P.

The time periods ΔT1 and ΔT2 may be adjusted according to a conveyance speed of the recording sheet P, for example, to cause the separators 23 to contact and separate from the fixing roller 21 at desired times, respectively, thus facilitating separation of the recording sheet P from the fixing roller 21.

Figure 8:
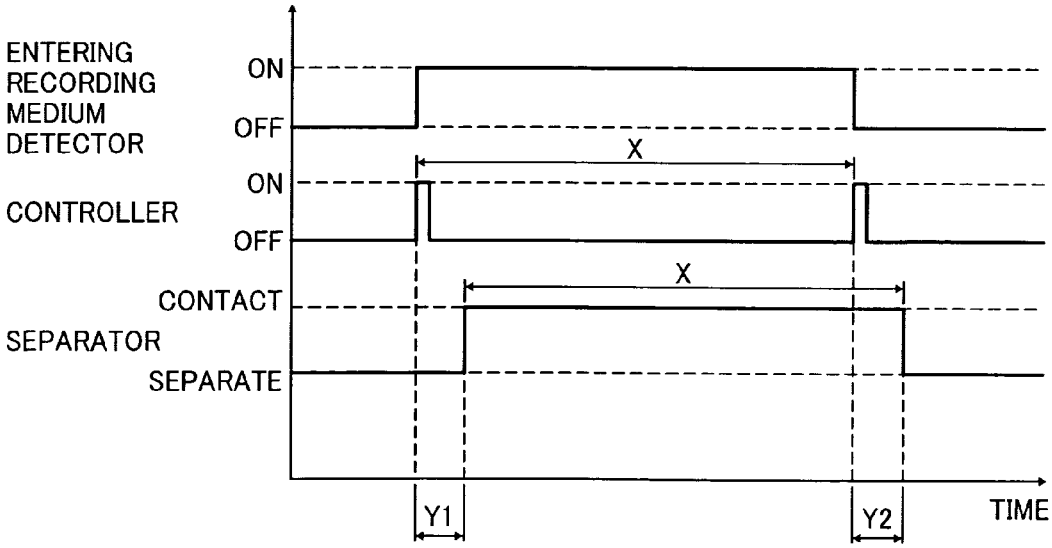
FIG. 8 is a timing chart showing one example of the operation of the entering recording medium detector, a controller, and the separators included in the fixing device shown in FIG. 3.

FIG. 8 is a timing chart showing one example of the operation of the entering recording medium detector 34, the controller 37, and the separators 23 described above.

Since a given operation time period is required after driving of the plunger 32 of the solenoid 30 starts until driving thereof ends, a time period Y1 is required after the controller 37 generates an ON signal, that is, the controller 37 is turned on, until the driven solenoid 30 causes the separators 23 to contact the fixing roller 21. Similarly, a time period Y2 is required after the controller 37 generates an ON signal, that is, the controller 37 is turned on, until the solenoid 30 causes the separators 23 to separate from the fixing roller 21. Accordingly, in a configuration in which the entering recording medium detector 34 is disposed in proximity to and upstream from the fixing nip N in the conveyance direction of the recording sheet P, the recording sheet P reaches the contact position B where the separators 23 contact the fixing roller 21 within a relatively short time after the entering recording medium detector 34 detects the recording sheet P. To address such circumstance, the position of the entering recording medium detector 34 needs to be determined so that the recording sheet P reaches the contact position B after the separators 23 contact the fixing roller 21.

For example, with a configuration in which the solenoid 30 is configured to be driven when a sheet sensor equivalent to the entering recording medium detector 34 that senses a signal every 10 ms detects five signals continuously each of which indicates that the entering recording medium detector 34 detects a recording sheet P, if the solenoid 30 is configured to operate for an operation time of 100 ms, that is, a time period required until the plunger 32 is pulled and retracted into the body 31 after power is supplied to the solenoid 30, the time period required until driving of the solenoid 30 starts and therefore the separators 23 contact the fixing roller 21 after the sheet sensor detects the recording sheet P is calculated as follows.

$$10\ \text{ms} \times 5(\text{times}) + 100\ \text{ms} = 150\ \text{ms}$$

It is to be noted that the sheet sensor senses the five signals to prevent malfunction caused by noise.

Further, in a configuration in which the recording sheet P is configured to be conveyed at a linear velocity of 120 mm/s, a conveyance distance of the recording sheet P for which the recording sheet P is conveyed after the sheet sensor detects the recording sheet P until the separators 23 contact the fixing roller 21 is calculated as follows.

$$120\ \text{mm/s} \times 150\ \text{ms} = 18\ \text{mm}$$

Figure 9:
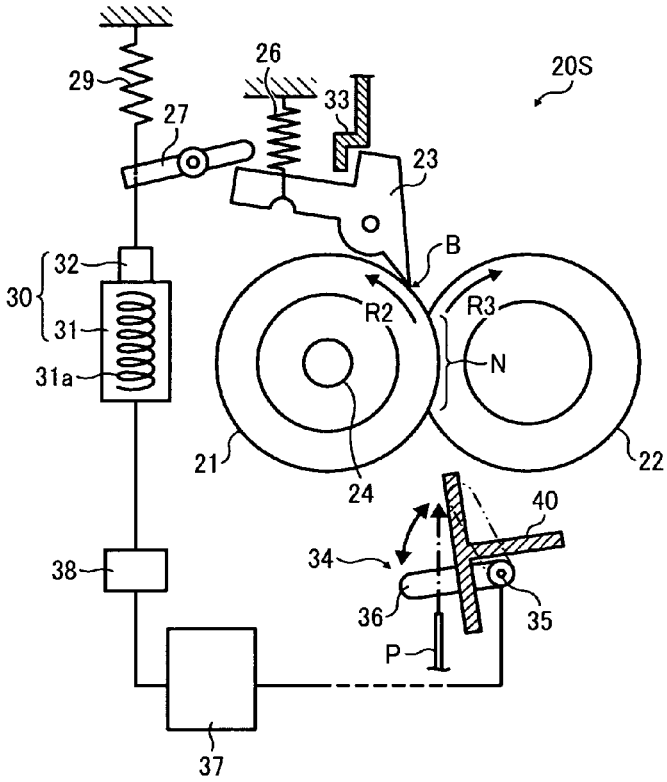
FIG. 9 is a vertical sectional view of a fixing device according to yet another example embodiment.

With this configuration, the sheet sensor needs to be disposed at a position upstream from the contact position B where the separators 23 contact the fixing roller 21 by 18 mm or more in the conveyance direction of the recording sheet P as shown in FIG. 9.

FIG. 9 is a vertical sectional view of a fixing device 20S employing such sheet sensor.

As illustrated in FIG. 9, the fixing device 20S includes an entry guide 40, which guides the recording sheet P to the fixing nip N, disposed upstream from the separators 23 by 30 mm in the conveyance direction of the recording sheet P. The entry guide 40 is attached with the feeler 36, that is, a sheet sensor, attaining the operation time of the solenoid 30 and the required distance between the sheet sensor and the separators 23. Accordingly, after the separators 23 contact the fixing roller 21, a leading edge of the recording sheet P reaches the contact position B where the separators 23 contact the fixing roller 21, and thus the separators 23 separate the recording sheet P from the fixing roller 21 precisely.

The timing chart of FIG. 8 shows the configuration in which the separators 23 contact the fixing roller 21 immediately before the recording sheet P reaches the separators 23 and separate from the fixing roller 21 immediately after the recording sheet P passes through the separators 23. With this configuration, the separators 23 contact the recording sheet P over the entire length of the recording sheet P in the conveyance direction thereof to separate the recording sheet P from the fixing roller 21. Alternatively, the separators 23 may not contact the recording sheet P over the entire length of the recording sheet P depending on the type of the recording sheet P.

Figure 10:
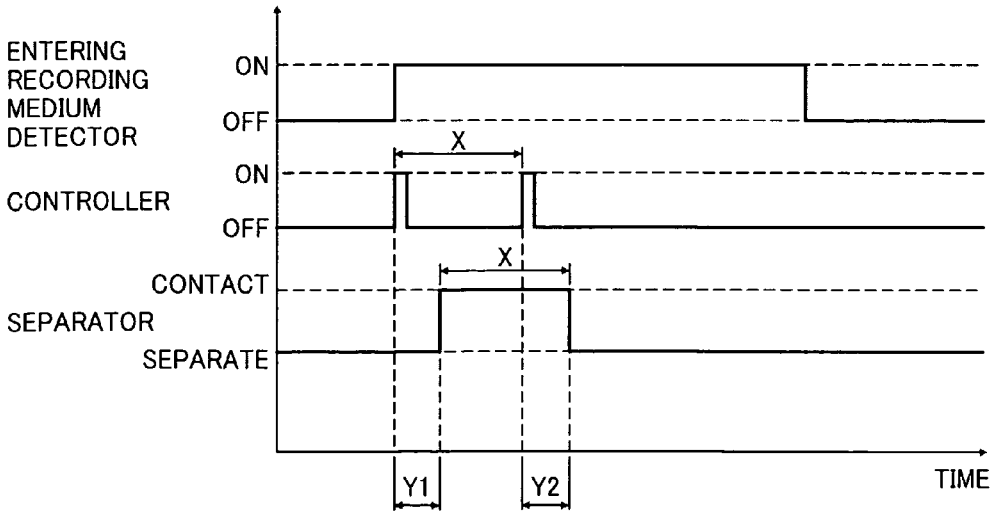
FIG. 10 is a timing chart showing another example of the operation of the entering recording medium detector, the controller, and the separators included in the fixing device shown in FIG. 3.

For example, with a rigid sheet having a paper weight of 66 g/m$^2$ or greater, such as plain paper and thick paper, used as a recording sheet P, once the separators 23 contact only the leading edge of the rigid sheet, the rigidity of the rigid sheet stabilizes its movement, discharging the rigid sheet from the fixing nip N along a guide disposed downstream from the fixing nip N in the conveyance direction of the recording sheet P. With the configuration shown in FIG. 8 in which the separators 23 contact the recording sheet P over the entire length of the recording sheet P in the conveyance direction of the recording sheet P, the separators 23 contact the fixing roller 21 for an increased contact time period X. By contrast, with the rigid sheet used as the recording sheet P, the separators 23 may contact only the leading edge of the recording sheet P, shortening the contact time period X for which the separators 23 contact the fixing roller 21 as shown in FIG. 10 illustrating a timing chart showing one example of the operation of the entering recording medium detector 34, the controller 37, and the separators 23 described above.

By contrast, with a soft sheet, such as thin paper having a paper weight of smaller than 66 g/m$^2$ and paper having a horizontal fibrous direction, used as a recording sheet P, if the separators 23 contact only the leading edge of the soft sheet to separate the soft sheet from the fixing roller 21, the soft sheet discharged from the fixing nip N is wound around the fixing roller 21 and sandwiched between the separators 23 and the fixing roller 21. Accordingly, the soft sheet discharged from the fixing nip N may not be conveyed properly. To address this problem, as shown in FIG. 8, the separators 23 contact the soft sheet for a longer contact time period X so that they contact the soft sheet over the entire length of the soft sheet in the conveyance direction thereof. Accordingly, the separators 23 can separate the soft sheet from the fixing roller 21 precisely, preventing wounding of the soft sheet around the fixing roller 21 and resultant jamming of the soft sheet.

With the above-described configuration, the contact time period X for which the separators 23 contact the fixing roller 21 is changed according to the paper weight of the recording sheet P, minimizing the contact time period X required for the separators 23 to separate the recording sheet P from the fixing roller 21. As a result, wear of the fixing roller 21 caused by contact of the separators 23 to the fixing roller 21 is decreased, extending the life of the fixing devices 20, 20', and 20S.

Alternatively, the contact time period X for which the separators 23 contact the fixing roller 21 may be changed according to the length of the recording sheet P in the conveyance direction thereof. For example, the length of an A4 size sheet in the conveyance direction thereof is 297 mm; the length of an A6 size sheet in the conveyance direction thereof is 148 mm. If the separators 23 contact the A4 size sheet for 100 mm in the conveyance direction thereof from the leading edge of the A4 size sheet, the separators 23 contact the A4 size sheet for about one-third of the entire length of 297 mm of the A4 size sheet in the conveyance direction thereof. By contrast, if the separators 23 contact the A6 size sheet for 100 mm in the conveyance direction thereof from the leading edge of the A6 size sheet, the separators 23 contact the A6 size sheet for about two-thirds of the entire length of 148 mm of the A6 size sheet in the conveyance direction thereof. Thus, the rate of the contact length of the A6 size sheet for which the separators 23 contact the A6 size sheet with respect to the entire length of the A6 size sheet in the conveyance direction thereof is greater than that of the A4 size sheet. However, the rate of the contact length of the A6 size sheet for which the separators 23 contact the A6 size sheet can be identical to that of the A4 size sheet to separate the A6 size sheet from the fixing roller 21. Accordingly, the contact length of the A6 size sheet for which the separators 23 contact the A6 size sheet can be about 50 mm, that is, one-third of the entire length of the A6 size sheet in the conveyance direction thereof.

As described above, even with the recording sheets P of the same material but having different lengths in the conveyance direction thereof, the contact time period X for which the separators 23 contact the fixing roller 21 is changed according to the length of the respective recording sheets P in the conveyance direction thereof so that the rate of the contact length of the separators 23 contacting the respective recording sheets P with respect to the entire length of the respective recording sheets P in the conveyance direction thereof is identical among the recording sheets P of various sizes. For example, with the recording sheet P having a shorter length in the conveyance direction thereof, the separators 23 contact the fixing roller 21 for a shorter contact time period X, eliminating unnecessary contact of the separators 23 to the fixing roller 21. Accordingly, wear of the fixing roller 21 due to contact with the separators 23 is decreased, thus extending the life of the fixing devices 20, 20', and 20S.

Alternatively, the contact time period X of the separators 23 for which the separators 23 contact the fixing roller 21 may be changed according to the rate of the imaged area with respect to the whole area on the surface of the recording sheet P (hereinafter referred to as the image forming rate) and the type of the toner image formed on the recording sheet P. Generally, a text toner image, that is, a monochrome toner image having a lower image forming rate, has a decreased adhering force that adheres the text toner image to the fixing roller 21, and therefore the recording sheet P bearing the text toner image separates from the fixing roller 21 easily. Accordingly, even when the separators 23 contact the recording sheet P only at the leading edge of the recording sheet P, the recording sheet P bearing the text toner image separates from the fixing roller 21, thus shortening the contact time period X for which the separators 23 contact the fixing roller 21 and therefore decreasing wear of the fixing roller 21.

Conversely, a photographic toner image, that is, a color toner image produced by superimposing toner images of a plurality of colors with a greater amount of toner and having a higher image forming rate, has an increased adhering force that adheres the photographic toner image to the fixing roller 21, and therefore the recording sheet P bearing the photographic toner image does not separate from the fixing roller 21 easily, resulting in jamming of the recording sheet P. To address this problem, the separators 23 may contact the recording sheet P over the imaged area on the recording sheet P, facilitating separation of the recording sheet P from the fixing roller 12.

As described above, the contact time period X for which the separators 23 contact the fixing roller 21 is changed according to the type of the toner image, the image forming rate, the paper weight of the recording sheet P, and the length of the recording sheet P in the conveyance direction thereof, thus eliminating unnecessary contact of the separators 23 to the fixing roller 21, extending the life of the fixing devices 20, 20', and 20S, and facilitating separation of the recording sheet P from the fixing roller 21.

It is to be noted that the type of the toner image, the image forming rate, the paper weight of the recording sheet P, and the length of the recording sheet P in the conveyance direction thereof are specified by the user by using the control panel of the image forming apparatus 100, for example. Thereafter, the specified data are sent to the controller 37 so that the controller 37 changes the contact time period X for which the separators 23 contact the fixing roller 21.

Figure 11:
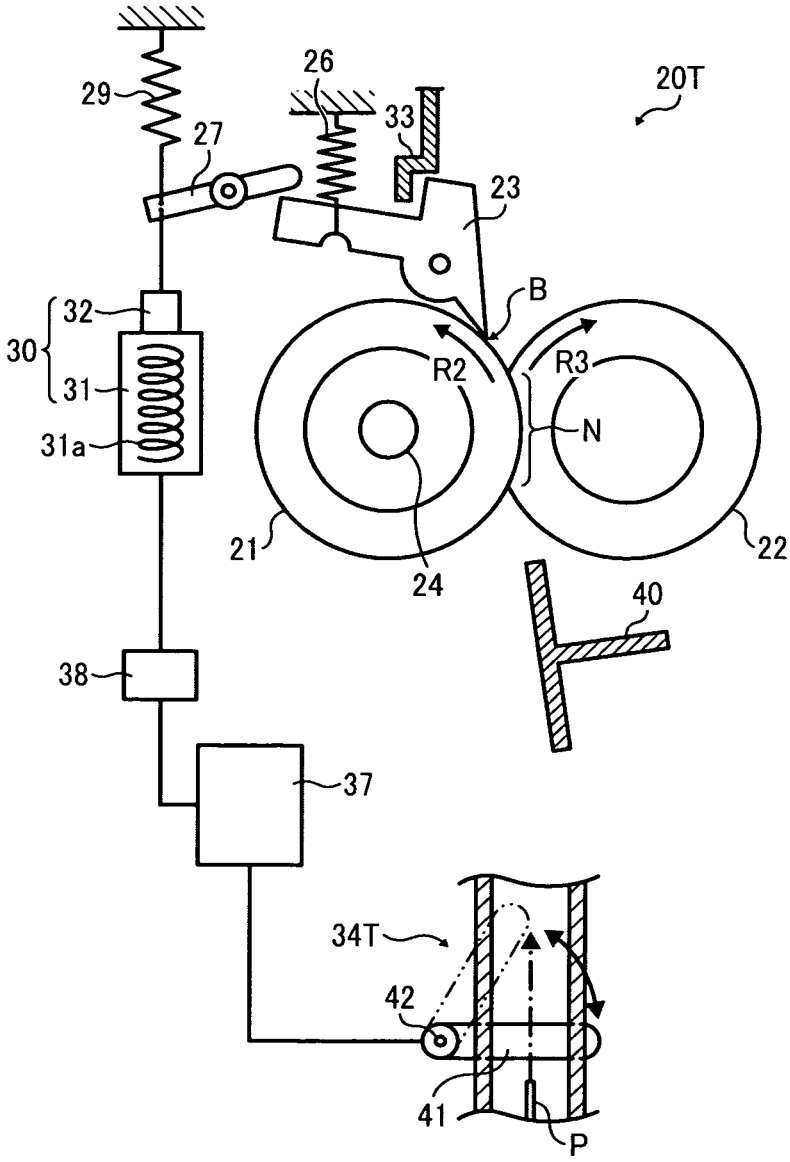
FIG. 11 is a vertical sectional view of a fixing device and an entering recording medium detector according to yet another example embodiment.

Referring to FIG. 11, the following describes a fixing device 20T according to yet another example embodiment of the present invention, which does not include the entering recording medium detector 34 depicted in FIG. 3. Instead, an entering recording medium detector 34T that employs a registration sensor 41 is disposed outside the fixing device 20T.

FIG. 11 is a vertical sectional view of the fixing device 20T and the entering recording medium detector 34T. As illustrated in FIG. 11, the registration sensor 41 of the entering recording medium detector 34T, disposed upstream from the fixing device 20T in the conveyance direction of the recording sheet P, detects a recording sheet P conveyed to the registration roller pair 19 depicted in FIG. 2. Like the feeler 36 depicted in FIG. 3, the registration sensor 41 is supported by an axis 42 in such a manner that the registration sensor 41 is rotatable or swingable about the axis 42. When the conveyed recording sheet P contacts the registration sensor 41, the registration sensor 41 detects the recording sheet P and outputs a detection signal based on which the registration roller pair 19 is turned on and off. Since the registration sensor 41 is used to rotate the registration roller pair 19, it is easy to move the separators 23 in synchronism with rotation of the registration roller pair 19. Additionally, the registration sensor 41 detects jamming of the recording sheet P. Since the registration sensor 41 is used as the entering recording medium detector 34T according to this example embodiment, when the registration sensor 41 detects the recording sheet P and outputs a detection signal, the controller 37 drives the solenoid 30 via the driving circuit 38 based on the detection signal.

It is to be noted that FIG. 11 illustrates the fixing device 20T in a state in which the separators 23 contact the fixing roller 21. The configuration and operation of the fixing device 20T that causes the separators 23 to contact and separate from the fixing roller 21 according to a signal output by the controller 37 is identical to that of the fixing device 20 depicted in FIGS. 3 and 4 as described above, and therefore the description of the configuration and operation of the fixing device 20T is omitted.

Figure 12:
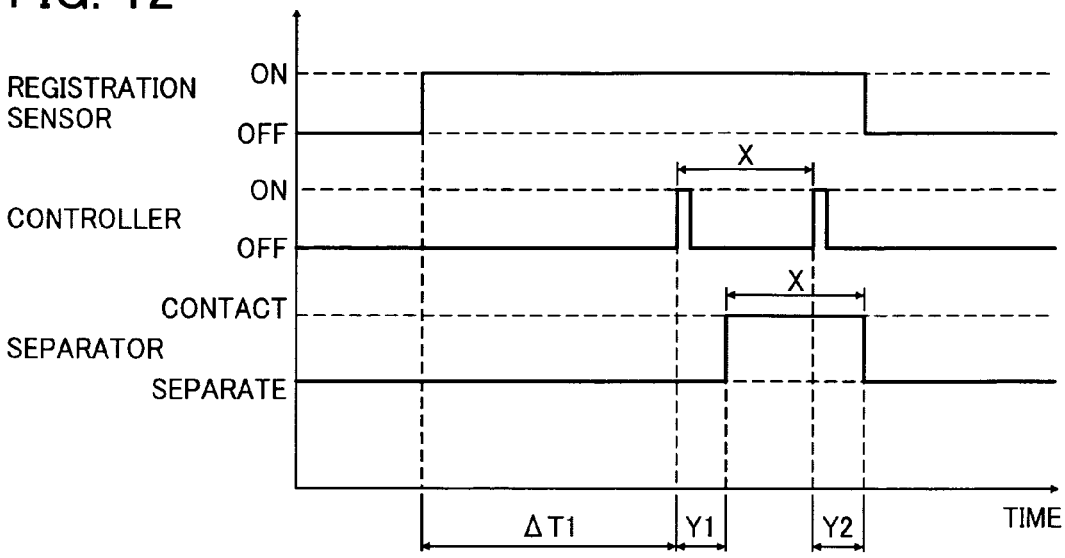
FIG. 12 is a timing chart showing one example of the operation of a registration sensor, the controller, and the separators included in the fixing device shown in FIG. 11.

FIG. 12 is a timing chart showing one example of the operation of the registration sensor 41, the controller 37, and the separators 23 of the fixing device 20T described above.

When the registration sensor 41 detects a recording sheet P and sends a detection signal to the controller 37, the controller 37 generates a first signal when a given time period ΔT1 elapses after receiving the detection signal from the registration sensor 41, and drives the solenoid 30. When an operation time period Y1 of the solenoid 30 elapses after the controller 37 generates the first signal, the separators 23 contact the fixing roller 21 to separate the recording sheet P from the fixing roller 21. It is to be noted that the given time period ΔT1 is provided, as described above by referring to FIG. 7, because there is a spare time after the registration sensor 41 detects the recording sheet P and before the recording sheet P contacts the separators 23. In other words, it is more preferable to cause the separators 23 to contact the fixing roller 21 immediately before the recording sheet P contacts the separators 23 so as to decrease wear of the fixing roller 21 than to cause the separators 23 to contact the fixing roller 21 by driving the solenoid 30 immediately after the registration sensor 41 detects the recording sheet P. Thereafter, when a given time period X elapses after the controller 37 generates the first signal, the controller 37 generates a second signal based on which driving of the solenoid 30 ceases. When an operation time period Y2 of the solenoid 30 elapses after the controller 37 generates the second signal, the separators 23 separate from the fixing roller 21.

Like in the fixing devices 20, 20', and 20S described above, even when the registration sensor 41 is used as the entering recording medium detector 34T, the separators 23 can separate the recording sheet P from the fixing roller 21. Further, the configuration shown in FIG. 11 does not require another separate detector that is installed in the fixing device 20T to detect the recording sheet P, reducing the number of parts of the fixing device 20T and therefore downsizing the fixing device 20T and reducing manufacturing costs of the fixing device 20T. Like in the fixing devices 20, 20', and 20S shown in FIGS. 3, 6, and 9, respectively, also in the fixing device 20T, the contact time period X for which the separators 23 contact the fixing roller 21 can be changed according to the type of the toner image, the image forming rate, the paper weight of the recording sheet P, and the length of the recording sheet P in the conveyance direction thereof.

Figure 13:
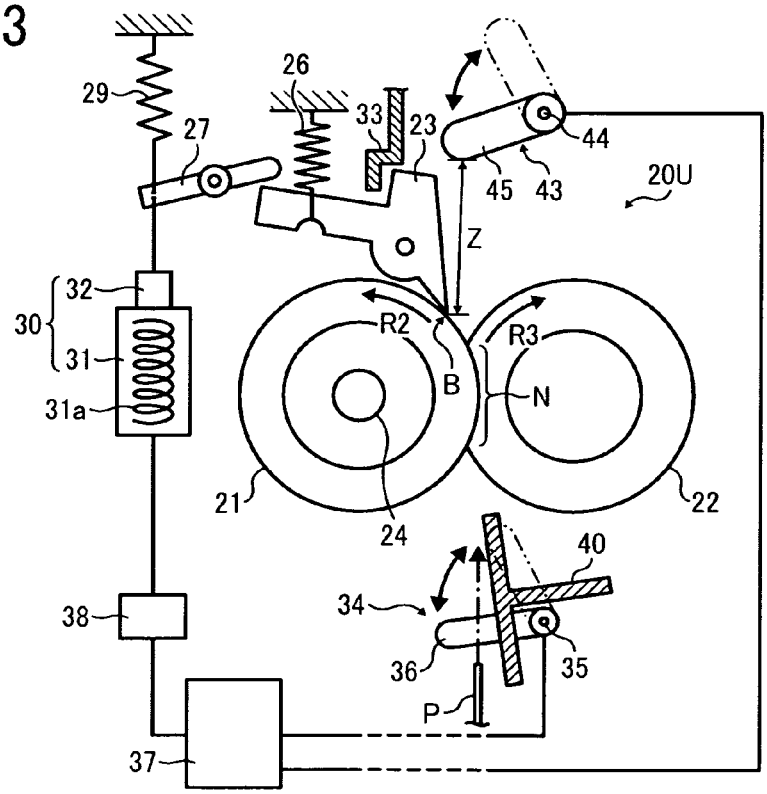
FIG. 13 is a vertical sectional view of a fixing device according to yet another example embodiment.

Referring to FIG. 13, the following describes a fixing device 20U according to yet another example embodiment of the present invention.

FIG. 13 is a vertical sectional view of the fixing device 20U including a discharged recording medium detector 43 that detects a recording sheet P discharged from the fixing nip N. As illustrated in FIG. 13, the discharged recording medium detector 43, disposed downstream from the fixing nip N in the conveyance direction of the recording sheet P, includes a feeler 45 that contacts and detects the recording sheet P and an axis 44 that supports the feeler 45 in such a manner that the feeler 45 is rotatable or swingable about the axis 44. When the conveyed recording sheet P contacts the feeler 45 of the discharged recording medium detector 43, the discharged recording medium detector 43 detects the recording sheet P. When the discharged recording medium detector 43 electrically connected to the controller 37 detects the recording sheet P and outputs a detection signal to the controller 37, the controller 37 stops driving of the solenoid 30 via the driving circuit 38. The other configuration of the fixing device 20U is equivalent to that of the fixing device 20 described above by referring to FIGS. 3 and 4.

Figure 14:
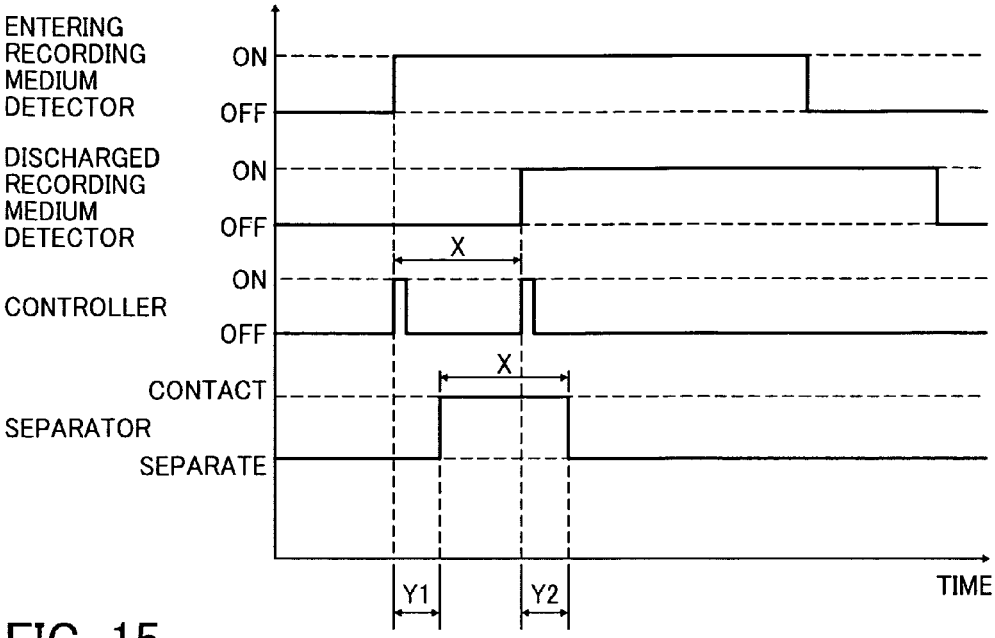
FIG. 14 is a timing chart showing one example of the operation of the entering recording medium detector, a discharged recording medium detector, the controller, and the separators included in the fixing device shown in FIG. 13.

FIG. 14 is a timing chart showing one example of the operation of the entering recording medium detector 34, the discharged recording medium detector 43, the controller 37, and the separators 23 of the fixing device 20U described above.

When the entering recording medium detector 34 detects a recording sheet P and sends a detection signal to the controller 37, the controller 37 generates a first signal and drives the solenoid 30. When the operation time period Y1 of the solenoid 30 elapses after the controller 37 generates the first signal, the separators 23 contact the fixing roller 21 to separate the recording sheet P from the fixing roller 21. Thereafter, the discharged recording medium detector 43 detects the recording sheet P and sends a detection signal to the controller 37. The controller 37 generates a second signal based on the detection signal from the discharged recording medium detector 43 based on which driving of the solenoid 30 ceases. When the operation time period Y2 of the solenoid 30 elapses after the controller 37 generates the second signal, the separators 23 separate from the fixing roller 21.

As described above, according to this example embodiment, the separators 23 can separate from the fixing roller 21 according to the detection signal generated by the discharged recording medium detector 43 upon detection of the recording sheet P. If an existing, discharged recording sheet sensor that detects jamming of the recording sheet P is disposed downstream from the fixing nip N in the conveyance direction of the recording sheet P, such discharged recording sheet sensor may be used as the discharged recording medium detector 43. Thus, the single sensor can conduct both detection of the recording sheet P for separation of the separators 23 from the fixing roller 21 and detection of the jammed recording sheet P, reducing the number of parts of the fixing device, downsizing the fixing device, and reducing manufacturing costs of the fixing device. Like in the fixing devices 20, 20', 20S, and 20T shown in FIGS. 3, 6, 9, and 11, respectively, also in the fixing device 20U, the contact time period X for which the separators 23 contact the fixing roller 21 can be changed according to the type of the toner image, the image forming rate, the paper weight of the recording sheet P, and the length of the recording sheet P in the conveyance direction thereof.

As the discharged recording medium detector 43 is disposed closer to the exit of the fixing nip N, the recording sheet P contacts the discharged recording medium detector 43 earlier, shortening the contact time period X for which the separators 23 contact the fixing roller 21 and therefore extending the life of the fixing device 20U. For example, where with the recording sheet P bent for 30 mm in the conveyance direction of the recording sheet P, a distance L defines the distance in a circumferential direction of the fixing roller 21 for which the separators 23 contact the fixing roller 21 during the contact time period X, and a distance Z depicted in FIG. 13 defines the distance between the contact position B on the fixing roller 21 where the separators 23 contact the fixing roller 21 and a lower edge of the discharged recording medium detector 43, the discharged recording medium detector 43 is disposed at a position that satisfies the relation of L+30 mm>Z. Accordingly, the discharged recording medium detector 43 is disposed at a position where the distance Z is smaller than the distance determined by considering the contact time period X for which the separators 23 contact the fixing roller 21 and an amount of bending of the recording sheet P, thus decreasing adverse effects caused by bending of the recording sheet P and variation in a bending amount of the recording sheet P and at the same time shortening the contact time period X for which the separators 23 contact the fixing roller 21.

With the configuration in which the separators 23 contact the recording sheet P over the entire length of the recording sheet P in the conveyance direction thereof, if driving of the solenoid 30 ceases when detection of the recording sheet P by the discharged recording medium detector 43 ceases, the separators 23 may contact the fixing roller 21 unnecessarily for a time period corresponding to the distance Z between the contact position B on the fixing roller 21 where the separators 23 contact the fixing roller 21 and the lower edge of the discharged recording medium detector 43. To address this problem, the separators 23 may contact the fixing roller 21 for a time period corresponding to a distance obtained by subtracting the distance Z from the distance L in the circumferential direction of the fixing roller 21 for which the separators 23 contact the fixing roller 21 during the contact time period X, thus reducing unnecessary contact of the separators 23 to the fixing roller 21, extending the life of the fixing device 20U, and facilitating stable separation of the recording sheet P from the fixing roller 21.

The image forming apparatus 100 depicted in FIG. 2 may have a curved conveyance path disposed downstream from the fixing device 20U in the conveyance direction of the recording sheet P. When the leading edge of the recording sheet P conveyed from the fixing device 20U contacts a guide plate disposed along the curved conveyance path, the recording sheet P is caught by the guide plate and therefore conveyed at a decreased conveyance speed, depending on the paper weight and the size of the recording sheet P and an environmental condition of the recording sheet P. If the guide plate disposed along the curved conveyance path decreases the conveyance speed of the recording sheet P contacting thereto before the trailing edge of the recording sheet P is discharged from the fixing nip N, the recording sheet P may be wound around the fixing roller 21 easily.

For example, in the fixing device 20U in which the separators 23 are configured to separate from the fixing roller 21 based on a detection signal output by the discharged recording medium detector 43, by the time when the leading edge of the recording sheet P discharged from the fixing nip N is caught by the guide plate disposed along the curved conveyance path and therefore the conveyance speed of the recording sheet P is decreased, the separators 23 have already separated from the fixing roller 21. Accordingly, the recording sheet P may be wound around the fixing roller 21 due to the decreased conveyance speed of the recording sheet P. Such winding of the recording sheet P around the fixing roller 21 may occur especially with the recording sheet P bearing an unfixed toner image formed of a relatively greater amount of toner, such as a full-color solid toner image.

Figure 15:
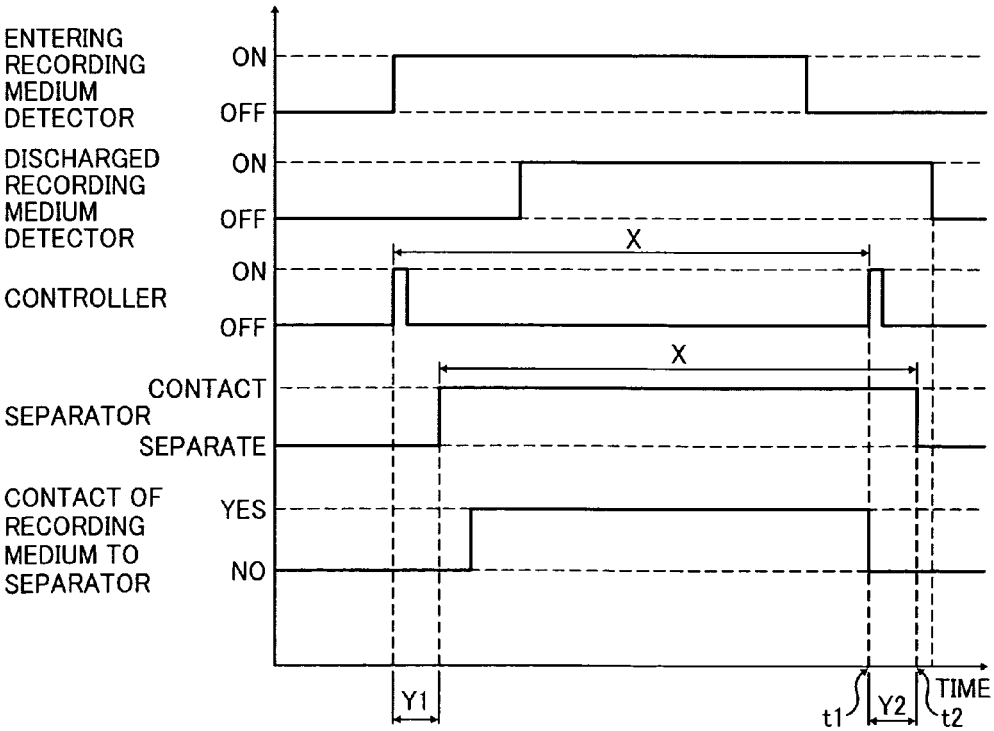
FIG. 15 is a timing chart showing another example of the operation of the entering recording medium detector, the discharged recording medium detector, the controller, and the separators included in the fixing device shown in FIG. 13.

To address this problem, with the configuration in which the conveyance speed of the recording sheet P may decrease while the recording sheet P passes through the fixing nip N, the separators 23 do not separate from the fixing roller 21 immediately after the discharged recording medium detector 43 detects the recording sheet P, but the separators 23 separate from the fixing roller 21 at a time t2 after a time t1 when the trailing edge of the recording sheet P contacts the separators 23 as shown in FIG. 15 illustrating a timing chart showing one example of the operation of the entering recording medium detector 34, the discharged recording medium detector 43, the controller 37, and the separators 23. Thus, the separators 23 remain in contact with the fixing roller 21 until the trailing edge of the recording sheet P contacts the separators 23, preventing the recording sheet P from being wound around the fixing roller 21 partially. Thereafter, as shown in FIG. 15, the controller 37 generates a signal at the time t1 when the trailing edge of the recording sheet P contacts the separators 23, and the separators 23 separate from the fixing roller 21, thus eliminating unnecessary contact of the separators 23 to the fixing roller 21 and extending the life of the fixing device 20U.

The above describes the configuration that prevents the problem of winding of the recording sheet P around the fixing roller 21 due to the decreased conveyance speed of the recording sheet P while the recording sheet P passes through the fixing nip N by referring to the fixing device 20U shown in FIG. 13. However, such problem may occur not only in the configuration shown in FIG. 13 in which the separators 23 are configured to separate from the fixing roller 21 based on a detection signal output by the discharged recording medium detector 43 but also in other configurations. To address this circumstance, the control method described above by referring to FIG. 15 is applicable to any fixing devices having configurations other than the configuration shown in FIG. 13.

The following describes advantages of the fixing devices 20, 20', 20S, 20T, and 20U according to the above-described example embodiments.

As shown in FIGS. 3 and 4, the opposed rotary body (e.g., the pressing roller 22) contacts the fixing rotary body (e.g., the fixing roller 21) to form a fixing nip (e.g., the fixing nip N) therebetween through which a recording medium (e.g., a recording sheet P) bearing a toner image passes. A plurality of separators (e.g., the separators 23) is disposed downstream from the fixing nip in a conveyance direction of the recording medium and is contactable to the fixing rotary body independently from each other. The plurality of separators contacts the fixing rotary body to separate the recording medium having passed through the fixing nip from the fixing rotary body. A plurality of contact direction biasing members (e.g., the contact direction biasing members 26) is attached to the plurality of separators to exert a first bias to the plurality of separators to cause the plurality of separators to contact the fixing rotary body. A separator presser (e.g., the separator presser 27) presses against the plurality of separators against the first bias exerted by the plurality of contact direction biasing members to separate the plurality of separators from the fixing rotary body. A single driver (e.g., the solenoid 30) is connected to the separator presser to separate the separator presser from the plurality of separators. An entering recording medium detector (e.g., the entering recording medium detector 34 depicted in FIGS. 3, 9, and 13, the entering recording medium detector 34T depicted in FIG. 11, and the optical sensor 39 depicted in FIG. 6) is disposed upstream from the fixing nip in the conveyance direction of the recording medium to detect the recording medium. A controller (e.g., the controller 37) is connected to the driver to control the driver based on a detection signal sent from the entering recording medium detector to change a contact time period for which the plurality of separators contacts the fixing rotary body.

As shown in FIG. 4, the driver drives the separator presser to cause the separators to contact the fixing rotary body. Thus, when a recording medium is supplied to the fixing nip, the driver drives the separator presser to cause the separators to contact the fixing rotary body so that the separators separate the recording medium from the fixing rotary body precisely. Conversely, as shown in FIG. 3, when a recording medium is not supplied to the fixing nip, the driver does not drive the separator presser, rendering the separators to separate from the fixing rotary body, thus minimizing wear of the fixing rotary body and facilitating formation of a high-quality toner image on the recording medium for an extended period of time.

The plurality of separators contacts and separates from the fixing rotary body independently from each other. Accordingly, even when the plurality of separators varies in dimension or the fixing rotary body is bent or vibrates, all of the plurality of separators contacts the surface of the fixing rotary body precisely, facilitating stable separation of the recording medium from the fixing rotary body and improving reliability.

With the separator presser connected to the single driver, the driver drives the separator presser to cause the plurality of separators to contact the fixing rotary body collectively. Conversely, the driver does not drive the separator presser, rendering the plurality of separators to separate from the fixing rotary body collectively. In other words, a plurality of drivers is not needed to move the plurality of separators, improving reliability of contact and separate operations of the separators, downsizing the fixing device, and reducing manufacturing costs of the fixing device.

A non-contact direction biasing member (e.g., the non-contact direction biasing member 29) is attached to the separator presser to exert a second bias thereto to press the separator presser against the plurality of separators. The driver exerts a driving force to the separator presser to separate the separator presser from the plurality of separators. The second bias of the non-contact direction biasing member is greater than the first bias of the contact direction biasing member, and the driving force of the driver is exerted in a direction opposite a direction of the second bias and greater than the second bias.

The driver, that is, the solenoid 30, includes the coil (e.g., the coil 31*a*) and the plunger (e.g., the plunger 32) movably disposed inside the coil. When the solenoid 30 is turned on, the plunger retracts into the coil to exert the driving force to the separator presser.

As illustrated in FIG. 4, when the separators contact the fixing rotary body, the separator presser does not contact the separators. Accordingly, the separators do not receive a force from the separator presser. That is, only with a bias exerted by the contact direction biasing member to the separator, each separator contacts the fixing rotary body. Thus, the front edge (e.g., the front edge 23*a*) of the separator, that is, a contact portion of the separator that contacts the fixing rotary body, slides over the surface of the fixing rotary body smoothly with appropriate pressure applied to the fixing rotary body.

The general-purpose solenoid 30 is used as the driver that drives the separator presser, minimizing manufacturing costs of the fixing device and enhancing reliability in operation. As shown in FIG. 3, when the solenoid 30 is not driven, a relation between the force exerted by the contact direction biasing member to the separator and the force exerted by the non-contact direction biasing member to the separator via the separator presser separates the separator from the fixing rotary body. In other words, the solenoid 30 is driven only to cause the separators to contact the fixing rotary body. Accordingly, the driver is simplified. Generally, a time period for which the separators contact the fixing rotary body is shorter than a time period for which the separators are isolated from the fixing rotary body. Accordingly, the solenoid 30 is driven only to cause the separators to contact the fixing rotary body, thus decreasing power distribution to the solenoid 30 and minimizing decrease in driving force of the plunger due to self-heating.

When the plurality of separators is isolated from the fixing rotary body, a plurality of detents (e.g., the detents 33) contacts and stops the plurality of separators at a given distance from the surface of the fixing rotary body. Thus, even with variation in dimension or assembly of the components included in the plurality of separators, an appropriate distance is maintained between the plurality of separators and the surface of the fixing rotary body.

As shown in FIG. 4, in a state in which the plurality of separators contacts the fixing rotary body, the separator presser is isolated from the plurality of separators.

Accordingly, the plurality of separators contacting the fixing rotary body does not receive a force from the separator presser. Consequently, the plurality of separators contacts the fixing rotary body solely by the bias exerted by the plurality of contact direction biasing members. Thus, the contact portion (e.g., the front edge 23*a*) of each of the plurality of separators contacts and slides over the surface of the fixing rotary body smoothly with appropriate pressure applied to the fixing rotary body.

The entering recording medium detector is disposed upstream from the fixing nip in the conveyance direction of the recording medium, and detects the recording medium. The controller connected to the driver controls the driver based on a detection signal sent from the entering recording medium detector.

Accordingly, before the recording medium reaches the plurality of separators, the controller drives the driver to cause the plurality of separators to contact the fixing rotary body so that the plurality of separators separates the recording medium from the fixing rotary body precisely.

The entering recording medium detector may be a contact type detector (e.g., the entering recording medium detectors 34 and 34T) that detects the recording medium by contacting the recording medium conveyed toward the fixing nip. The contact type detector includes the feeler (e.g., the feeler 36 and the registration sensor 41) that contacts the recording medium and is disposed in proximity to a center of the recording medium conveyance path (e.g., the conveyance path R depicted in FIG. 2) in the width direction of the recording medium conveyance path perpendicular to the conveyance direction of the recording medium.

Accordingly, even when the recording medium contacts the feeler of the entering recording medium detector, the recording medium is not skewed, preventing distortion of the toner image on the recording medium and creasing of the recording medium.

Alternatively, the entering recording medium detector may be a non-contact type detector (e.g., the optical sensor 39) that detects the recording medium without contacting the recording medium conveyed toward the fixing nip. Accordingly, the recording medium does not contact the entering recording medium detector, preventing skew of the recording medium.

The jam detector (e.g., the entering recording medium detectors 34 and 34T and the optical sensor 39) is disposed upstream from the fixing nip in the conveyance direction of the recording medium, and detects a jammed recording medium. The jam detector also serves as the entering recording medium detector that detects the recording medium conveyed toward the fixing nip. Accordingly, a separate detector that detects the recording medium conveyed toward the fixing nip is not needed, downsizing the fixing device and reducing manufacturing costs of the fixing device.

As shown in FIG. 11, the entering recording medium detector may be the registration sensor (e.g., the registration sensor 41) that detects the recording medium conveyed toward the registration roller pair 19 depicted in FIG. 2 disposed upstream from the fixing device in the conveyance direction of the recording medium. Accordingly, a separate detector that detects the recording medium conveyed toward the fixing nip is not needed, reducing the number of parts of the fixing device and therefore downsizing the fixing device and reducing manufacturing costs of the fixing device.

The controller changes a first time period (e.g., the time period $\Delta T1$) that elapses before the controller starts driving the driver after the entering recording medium detector detects the recording medium. Accordingly, the plurality of separators contacts and separates from the fixing rotary body at a desired time to separate the recording medium from the fixing rotary body effectively.

A given operation time period of the driver is provided after driving of the driver starts until driving thereof is finished. Simultaneously, the entering recording medium detector is spaced away from the separators with a first distance (e.g., the distance E depicted in FIG. 4) between the entering recording medium detector and the contact position B on the fixing rotary body where the separators contact the fixing rotary body, so that the separators contact the fixing rotary body before the recording medium detected by the entering recording medium detector reaches the contact position B on the fixing rotary body where the separators contact the fixing rotary body. Accordingly, the recording medium reaches the contact position B on the fixing rotary body after the separators contact the fixing rotary body, thus facilitating separation of the recording medium from the fixing rotary body.

As shown in FIGS. 8 and 10, the controller changes the contact time period for which the separators contact the fixing rotary body according to at least one of the paper weight of the recording medium, the length of the recording medium in the conveyance direction thereof, the rate of the imaged area with respect to the whole surface area of the recording medium, that is, the image forming rate, and the type of a toner image formed on the recording medium. Accordingly, the separators do not contact the fixing rotary body unnecessarily, extending the life of the fixing device and facilitating stable separation of the recording medium from the fixing rotary body.

As shown in FIG. 13, the discharged recording medium detector (e.g., the discharged recording medium detector 43), disposed downstream from the fixing nip in the conveyance direction of the recording medium, detects the recording medium discharged from the fixing nip. The controller separates the separators from the fixing rotary body based on a detection signal sent from the discharged recording medium detector.

The jam detector (e.g., the discharged recording medium detector 43), disposed downstream from the fixing nip in the conveyance direction of the recording medium, detects a jammed recording medium. The jam detector also serves as the discharged recording medium detector that detects the recording medium discharged from the fixing nip. Thus, both movement of the separators and detection of the jammed recording medium are performed by the identical detector. Accordingly, a separate detector that detects the recording medium discharged from the fixing nip is not needed, reducing the number of parts of the fixing device and therefore downsizing the fixing device and reducing manufacturing costs of the fixing device.

The discharged recording medium detector is disposed at a position spaced away from the separators with a second distance (e.g., the distance Z depicted in FIG. 13) between the contact position B on the fixing rotary body where the separators contact the fixing rotary body and the lower edge of the discharged recording medium detector, which is determined based on the contact time period for which the separators contact the fixing rotary body and an amount of bending of the recording medium discharged from the fixing nip. For example, the distance between the contact position B on the fixing rotary body and the discharged recording medium detector is shorter than a distance determined based on the contact time period for which the separators contact the fixing rotary body and the amount of bending of the recording medium, thus decreasing adverse effects caused by bending of the recording medium and variation in the bending amount of the recording medium and at the same time shortening the contact time period for which the separators contact the fixing rotary body.

With the configuration in which the conveyance speed of the recording medium is decreased while the recording medium passes through the fixing nip, the controller maintains the separators in contact with the fixing rotary body until the trailing edge of the recording medium in the conveyance direction of the recording medium contacts the separators. That is, the controller separates the separators from the fixing rotary body when a second time period required for the trailing edge of the recording medium in the conveyance direction of the recording medium detected by the entering recording medium detector to reach the separators elapses after the entering recording medium detector detects the recording medium.

As the conveyance speed of the recording medium decreases, the recording medium is wound around the fixing rotary body easily. To address this problem, the separators maintain in contact with the fixing rotary body until the trailing edge of the recording medium contacts the separators, thus separating the recording medium from the fixing rotary body precisely.

The separators separate from the fixing rotary body after the trailing edge of the recording medium contacts the separators. Accordingly, even when the conveyance speed of the recording medium decreases while the recording medium passes through the fixing nip, the separators maintain in contact with the fixing rotary body until the trailing edge of the recording medium contacts the separators, thus separating the recording medium from the fixing rotary body precisely.

The fixing device providing the advantages described above is installable in the image forming apparatus (e.g., the image forming apparatus 100 depicted in FIG. 2).

In the fixing devices 20, 20', 20S, 20T, and 20U according to the above-described example embodiments, the fixing roller 21 is used as a fixing rotary body and the pressing roller 22 is used as an opposed rotary body disposed opposite the fixing rotary body. Alternatively, the fixing rotary body and the opposed rotary body may not be a roller. For example, at least one of the fixing rotary body and the opposed rotary body may be a belt or a film. Further, the fixing device 20, 20', 20S, 20T, or 20U is installed in the image forming apparatus 100 serving as a color image forming apparatus for forming a color image. Alternatively, the fixing device 20, 20', 20S, 20T, or 20U may be installed in a monochrome image forming apparatus for forming a monochrome image such as a copier, a printer, a facsimile machine, a multifunction printer having at least one of copying, printing, and facsimile functions, or the like.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing rotary body;

an opposed rotary body to contact the fixing rotary body to form a fixing nip therebetween through which a recording medium bearing a toner image passes;

a plurality of separators disposed downstream from the fixing nip in a conveyance direction of the recording medium and contactable to the fixing rotary body independently from each other, the plurality of separators to contact the fixing rotary body to separate the recording medium having passed through the fixing nip from the fixing rotary body;

a plurality of contact direction biasing members attached to the plurality of separators to exert a first bias to the plurality of separators to cause the plurality of separators to contact the fixing rotary body;

a separator presser to press against the plurality of separators against the first bias exerted by the plurality of contact direction biasing members to separate the plurality of separators from the fixing rotary body;

a single driver connected to the separator presser to separate the separator presser from the plurality of separators;

an entering recording medium detector disposed upstream from the fixing nip in the conveyance direction of the recording medium to detect the recording medium; and a controller connected to the driver to control the driver based on a detection signal sent from the entering recording medium detector to change a contact time period for which the plurality of separators contacts the fixing rotary body, wherein the entering recording medium detector includes a registration sensor to detect the recording medium conveyed toward a registration roller pair disposed upstream from the fixing device in the conveyance direction of the recording medium.

2. The fixing device according to claim 1, further comprising a non-contact direction biasing member attached to the separator presser to exert a second bias thereto to press the separator presser against the plurality of separators, wherein the driver exerts a driving force to the separator presser to separate the separator presser from the plurality of separators, and wherein the second bias of the non-contact direction biasing member is greater than the first bias of the plurality of contact direction biasing members, and the driving force of the driver is exerted in a direction opposite a direction of the second bias and greater than the second bias.

3. The fixing device according to claim 2, wherein the driver includes a solenoid including:

a coil; and a plunger movably disposed inside the coil, and wherein, when the solenoid is turned on, the plunger retracts into the coil to exert the driving force to the separator presser.

4. The fixing device according to claim 1, further comprising a plurality of detents to contact and stop the plurality of separators, wherein, when the plurality of separators are isolated from the fixing rotary body, the plurality of detents stops the plurality of separators at a given distance from the fixing rotary body.

5. The fixing device according to claim 1, wherein, in a state in which the plurality of separators contacts the fixing rotary body, the separator presser is isolated from the plurality of separators.

6. The fixing device according to claim 1, wherein the entering recording medium detector includes a contact type detector to detect the recording medium by contacting the recording medium conveyed toward the fixing nip, the contact type detector including a feeler to contact the recording medium and disposed in proximity to a center of a recording medium conveyance path in a width direction of the recording medium conveyance path perpendicular to the conveyance direction of the recording medium.

7. The fixing device according to claim 1, wherein the entering recording medium detector includes a non-contact type detector to detect the recording medium without contacting the recording medium conveyed toward the fixing nip.

8. The fixing device according to claim 1, wherein the entering recording medium detector further detects a jammed recording medium.

9. The fixing device according to claim 1, wherein the controller changes a first time period that elapses before the controller starts driving the driver after the entering recording medium detector detects the recording medium.

10. The fixing device according to claim 1, wherein the entering recording medium detector is spaced away from the plurality of separators with a first distance between the entering recording medium detector and a contact position on the fixing rotary body where the plurality of separators contacts the fixing rotary body, the first distance causing the plurality of separators to contact the fixing rotary body before the recording medium detected by the entering recording medium detector reaches the contact position on the fixing rotary body where the plurality of separators contacts the fixing rotary body.

11. The fixing device according to claim 1, wherein the controller changes the contact time period for which the plurality of separators contacts the fixing rotary body according to at least one of a paper weight of the recording medium, a length of the recording medium in the conveyance direction of the recording medium, a rate of an imaged area with respect to a whole surface area of the recording medium, and a type of the toner image formed on the recording medium.

12. The fixing device according to claim 1, wherein the controller separates the plurality of separators from the fixing rotary body when a second time period required for a trailing edge of the recording medium in the conveyance direction of the recording medium detected by the entering recording medium detector to reach the plurality of separators elapses after the entering recording medium detector detects the recording medium.

13. The fixing device according to claim 1, further comprising a discharged recording medium detector disposed downstream from the fixing nip in the conveyance direction of the recording medium to detect the recording medium discharged from the fixing nip, wherein the controller separates the plurality of separators from the fixing rotary body based on a detection signal sent from the discharged recording medium detector.

14. The fixing device according to claim 13, wherein the discharged recording medium detector further detects a jammed recording medium.

15. The fixing device according to claim 13, wherein the discharged recording medium detector is spaced away from the plurality of separators with a second distance between a contact position on the fixing rotary body where the plurality of separators contacts the fixing rotary body and the discharged recording medium detector, the second distance being determined based on the contact time period for which the plurality of separators contacts the fixing rotary body and an amount of bending of the recording medium discharged from the fixing nip.

16. An image forming apparatus comprising the fixing device according to claim 1.

17. A fixing device comprising:

a fixing rotary body;

an opposed rotary body to contact the fixing rotary body to form a fixing nip therebetween through which a recording medium bearing a toner image passes;

a plurality of separators disposed downstream from the fixing nip in a conveyance direction of the recording medium and contactable to the fixing rotary body independently from each other, the plurality of separators to contact the fixing rotary body to separate the recording medium having passed through the fixing nip from the fixing rotary body;

a plurality of contact direction biasing members attached to the plurality of separators to exert a first bias to the plurality of separators to cause the plurality of separators to contact the fixing rotary body;

a separator presser to press against the plurality of separators against the first bias exerted by the plurality of contact direction biasing members to separate the plurality of separators from the fixing rotary body;

a single driver connected to the separator presser to separate the separator presser from the plurality of separators;

an entering recording medium detector disposed upstream from the fixing nip in the conveyance direction of the recording medium to detect the recording medium;

a controller connected to the driver to control the driver based on a detection signal sent from the entering recording medium detector to change a contact time period for which the plurality of separators contacts the fixing rotary body; and a discharged recording medium detector disposed downstream from the fixing nip in the conveyance direction of the recording medium to detect the recording medium discharged from the fixing nip, wherein the controller separates the plurality of separators from the fixing rotary body based on a detection signal sent from the discharged recording medium detector.

18. An image forming apparatus, comprising:

the fixing device of claim 17.

* * * * *